US012098050B2

(12) United States Patent
Matsumoto et al.

(10) Patent No.: US 12,098,050 B2
(45) **Date of Patent: *Sep. 24, 2024**

(54) RECORDING MATERIAL PROCESSING APPARATUS

(71) Applicant: FUJIFILM Business Innovation Corp., Tokyo (JP)

(72) Inventors: Masashi Matsumoto, Yokohama (JP); Mitsuhiro Nakamura, Yokohama (JP); Takayuki Uchiyama, Yokohama (JP); Takumi Uegane, Yokohama (JP); Satoko Monoe, Yokohama (JP); Taichi Fuchu, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/305,533

(22) Filed: Apr. 24, 2023

(65) Prior Publication Data

US 2023/0249937 A1 Aug. 10, 2023

Related U.S. Application Data

(63) Continuation of application No. 17/403,535, filed on Aug. 16, 2021.

(30) Foreign Application Priority Data

Apr. 27, 2021 (JP) ..... 2021-075428
Apr. 27, 2021 (JP) ..... 2021-075429
Apr. 27, 2021 (JP) ..... 2021-075430

(51) Int. Cl.
*B65H 37/04* (2006.01)

(52) U.S. Cl.
CPC ..... *B65H 37/04* (2013.01); *B65H 2301/4223* (2013.01); *B65H 2301/43828* (2013.01)

(58) Field of Classification Search
CPC ..... B65H 2301/43828; B65H 37/04; B65H 2301/4228; B65H 2301/51616; B65H 2301/4223
See application file for complete search history.

(56) References Cited

U.S. PATENT DOCUMENTS

| | | | |
|---|---|---|---|
| 3,643,303 | A | 2/1972 | Kanarek |
| 7,717,035 | B1 | 5/2010 | Gray |
| 11,097,919 | B2 | 8/2021 | Matsumoto et al. |
| 2014/0219747 | A1 | 8/2014 | Takahashi et al. |
| 2015/0093214 | A1 | 4/2015 | Takahashi et al. |

(Continued)

FOREIGN PATENT DOCUMENTS

| | | | |
|---|---|---|---|
| EP | 1798025 | A1 | 6/2007 |
| JP | 2014-118300 | A | 6/2014 |

(Continued)

*Primary Examiner* — Jennifer Bahls
(74) *Attorney, Agent, or Firm* — Oliff PLC

(57) ABSTRACT

A recording material processing apparatus includes: first teeth that are used for binding processing of a recording material bundle; second teeth configured to move toward the first teeth and to press the recording material bundle positioned between the first teeth and the second teeth; a first metal block configured to support the first teeth; and a second metal block configured to support the second teeth.

9 Claims, 21 Drawing Sheets

(56) References Cited

U.S. PATENT DOCUMENTS

| | | | | |
|---|---|---|---|---|
| 2017/0008723 | A1 | 1/2017 | Shimizu et al. | |
| 2017/0315492 | A1* | 11/2017 | Kobayashi | G03G 15/6541 |
| 2018/0273336 | A1* | 9/2018 | Sato | B65H 37/04 |
| 2018/0339484 | A1* | 11/2018 | Takahashi | B65H 37/04 |
| 2020/0172367 | A1 | 6/2020 | Tanoue et al. | |

FOREIGN PATENT DOCUMENTS

| | | | |
|---|---|---|---|
| JP | 2014-148398 | A | 8/2014 |
| JP | 2015-229262 | A | 12/2015 |
| JP | 2019-163123 | A | 9/2019 |
| JP | 2019181733 | A | 10/2019 |
| JP | 2020-093929 | A | 6/2020 |
| JP | 2020-097478 | A | 6/2020 |
| WO | 2010138990 | A1 | 12/2010 |

* cited by examiner

RECORDING MATERIAL PROCESSING APPARATUS

CROSS-REFERENCE TO RELATED APPLICATIONS

This application is a continuation of U.S. patent application Ser. No. 17/403,535 filed on Aug. 16, 2021, which is based on and claims priority under 35 USC 119 from Japanese Patent Application No. 2021-075428 filed on Apr. 27, 2021, Japanese Patent Application No. 2021-075429 filed on Apr. 27, 2021, and Japanese Patent Application No. 2021-075430 filed on Apr. 27, 2021, the entire disclosures of each of which are hereby incorporated by reference.

BACKGROUND

Technical Field

The present invention relates to a recording material processing apparatus.

Related Art

Patent Literature 1 discloses a sheet processing apparatus having a fixing means for fixing a second teeth form moved to a position, in which it meshes with a first teeth form, to a second support means.

Patent Literature 2 discloses a sheet binding apparatus having a first link member whose one end is rotatably connected to a movable pressing member, and a second link member whose one end is rotatably connected to a fixed member fixed to an apparatus body.

CITATION LIST

Patent Literature

Patent Literature 1: JP-A-2015-229262
Patent Literature 2: JP-A-2014-148398

SUMMARY

As for binding processing for a recording material bundle, for example, binding processing for a recording material bundle of advancing teeth toward the recording material bundle, and pressing the teeth against the recording material bundle is performed, in some cases.

Here, when the teeth are supported by a plate or the like and support of the teeth is unstable, a malfunction such as a decrease in binding reliability is likely to occur.

Aspects of non-limiting embodiments of the present disclosure relate to stabilizing binding processing for a recording material bundle, as compared to a case where teeth are supported by a plate.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording material processing apparatus including: first teeth that are used for binding processing of a recording material bundle; second teeth configured to move toward the first teeth and to press the recording material bundle positioned between the first teeth and the second teeth; a first metal block configured to support the first teeth; and a second metal block configured to support the second teeth.

BRIEF DESCRIPTION OF DRAWINGS

Exemplary embodiment(s) of the present invention will be described in detail based on the following figures, wherein.

DESCRIPTION OF EMBODIMENTS

Hereinafter, embodiments of the present disclosure will be described in detail with reference to the accompanying drawings.

Figure 1:
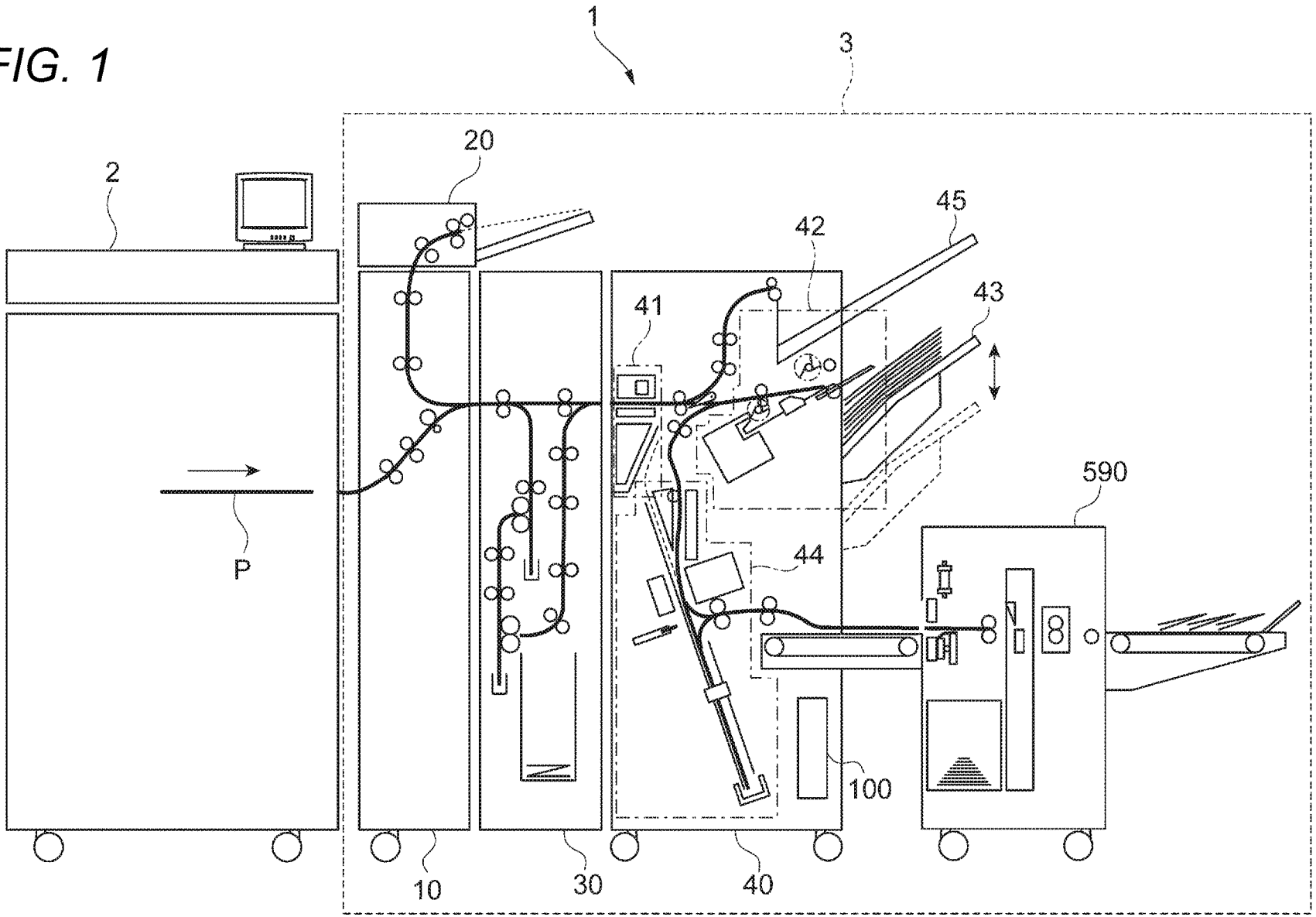
FIG. 1 shows an entire configuration of an image forming system.

FIG. 1 shows an entire configuration of an image forming system 1.

The image forming system 1 shown in FIG. 1 includes an image forming apparatus 2 configured to form an image on a sheet P as an example of the recording material, and a sheet processing apparatus 3 configured to implement predetermined processing on the sheet P on which an image has been formed by the image forming apparatus 2.

Here, the image forming apparatus 2 is configured to form an image on the sheet P by using an electrophotographic method or an inkjet method.

The sheet processing apparatus 3 as an example of the recording material processing apparatus is provided with a conveyor device 10 configured to convey the sheet P output from the image forming apparatus 2 toward a downstream side, and a slip sheet supply device 20 configured to supply a slip sheet such as a thick sheet and a windowed sheet P to the sheet P that is conveyed by the conveyor device 10.

The sheet processing apparatus 3 is also provided with a folding device 30 configured to implement folding processing such as inner tri-folding (C-folding) and outer tri-folding (Z-folding) on the sheet P conveyed from the conveyor device 10.

The sheet processing apparatus 3 is also provided with a first post-processing device 40 provided downstream of the folding device 30 and configured to perform perforation, end binding, saddle binding and the like on the sheet P.

Additionally describing, the downstream side of the folding device 30 is provided with the first post-processing device 40 configured to perform processing on a sheet bundle (an example of the recording material bundle) consisting of plural sheets P on which images have been formed by the image forming apparatus 2, or to perform processing on each of sheets P.

The sheet processing apparatus 3 is also provided with a second post-processing device 590 provided downstream of the first post-processing device 40 and configured to further perform processing on the sheet bundle saddle folded or saddle stitched.

The sheet processing apparatus 3 is also provided with a control unit 100 having a CPU (Central Processing Unit) configured to execute a program and configured to control the entire sheet processing apparatus 3.

The first post-processing device 40 is provided with a perforation unit 41 configured to perforate (punch) the sheet P, and an end binding stapler unit 42 configured to stitch an end of the sheet bundle.

The first post-processing device 40 is also provided with a first stacking part 43 on which the sheet P passing through the end binding stapler unit 42 is stacked, and a second stacking part 45 on which the sheet P for which the processing has not been performed in the first post-processing device 40 or the sheet P for which only perforation has been performed is stacked.

The first post-processing device 40 is also provided with a saddle binding unit 44 configured to perform saddle folding/saddle binding on the sheet bundle so as to make a spread-shaped booklet.

Figure 2:
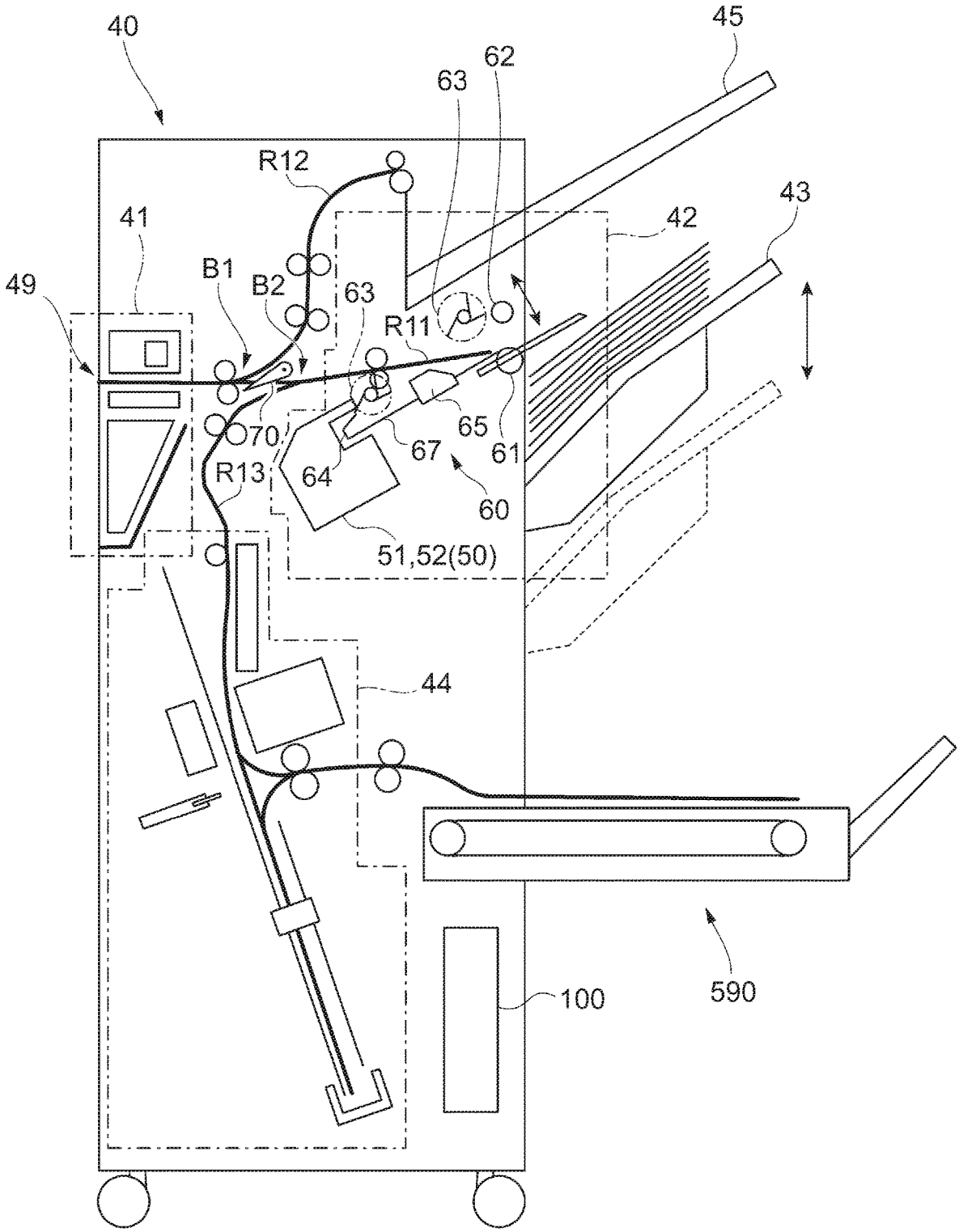
FIG. 2 shows a configuration of a first post-processing device.

FIG. 2 shows a configuration of the first post-processing device 40.

The first post-processing device 40 is provided with a receiving opening 49 configured to receive the sheet P conveyed from the folding device 30.

The perforation unit 41 is provided immediately behind the receiving opening 49. The perforation unit 41 is configured to perform perforation (punching) such as two holes and four holes on the sheet P conveyed to the first post-processing device 40.

A first sheet conveying path R11 provided from the receiving opening 49 to the end binding stapler unit 42 and used to convey the sheet P received in the receiving opening 49 to the end binding stapler unit 42 is provided.

Also, a second sheet conveying path R12 branched from the first sheet conveying path R11 at a first branch point B1 and used to convey the sheet P to the stacking part 45 is provided.

Also, a third sheet conveying path R13 branched from the first sheet conveying path R11 at a second branch point B2 and used to convey the sheet P to the saddle binding unit 44 is provided.

Further, a switching gate 70 configured to switch (set) a conveying destination of the sheet P to any one of the first sheet conveying path R11 to the third sheet conveying path R13 is provided.

The end binding stapler unit 42 is provided with a sheet stacking unit 60 configured to stack a required number of sheets P to generate a sheet bundle.

The sheet stacking unit 60 is provided with a support plate 67 arranged inclined with respect to a horizontal direction and configured to support the conveyed sheet P from below. In the exemplary embodiment, the sheet bundle is formed on the support plate 67.

The end binding stapler unit 42 is also provided with a binding processing device 50 configured to execute binding (end binding) on an end portion of the sheet bundle generated in the sheet stacking unit 60.

Note that, in the exemplary embodiment, as described later, two binding processing devices 50 of a first binding processing device 51 configured to perform binding processing by using a staple needle and a second binding processing device 52 configured to perform binding processing without using a staple needle are provided.

The end binding stapler unit 42 is also provided with a conveying roll 61 configured to rotationally drive and to deliver the sheet bundle generated in the sheet stacking unit 60 toward the first stacking part 43.

Further, a movable roll 62 configured to be movable to a position retreated from the conveying roll 61 and a position in which it presses against the conveying roll 61 is provided.

Here, when performing processing by the end binding stapler unit 42, the conveyed sheet P is first received in the receiving opening 49.

Then, the sheet P is conveyed along the first sheet conveying path R11 and reaches the end binding stapler unit 42.

Then, the sheet P is conveyed above the support plate 67 and is then dropped onto the support plate 67. Also, the sheet P is supported from above by the support plate 67 and slides on the support plate 67 by inclination given by the support plate 67 and by a rotation member 63.

Thereafter, the sheet P collides with end guides 64 attached to an end portion of the support plate 67. Additionally describing, in the exemplary embodiment, the end portion of the support plate 67 is provided with end guides 64 extending upward in FIG. 2, and the sheet P moving on the support plate 67 collides with the end guides 64.

Thereby, in the exemplary embodiment, the moving of the sheet P is stopped. Thereafter, this operation is performed each time the sheet P is conveyed from an upstream side, and a sheet bundle in which the sheets P are aligned is generated on the support plate 67.

Note that, in the exemplary embodiment, a sheet width position aligning member 65 configured to align neatly a position in a width direction of the sheet bundle is further provided.

In the exemplary embodiment, each time the sheet P is supplied on the support plate 67, an end portion (side portion) in the width direction of the sheet P is pressed by the sheet width position aligning member 65, so that the position in the width direction of the sheet P (sheet bundle) is also aligned neatly.

When a preset number of sheets P are stacked on the support plate 67, an end portion of the sheet bundle is stitched by the first binding processing device 51 or second binding processing device 52.

Note that, the first binding processing device 51 is configured to execute binding by striking a metallic staple (U-shaped needle) into the sheet bundle. Also, the second binding processing device 52 is configured to execute binding by sandwiching the sheet bundle with two binding teeth and pressing the sheets constituting the sheet bundle each other.

Then, in the exemplary embodiment, the movable roll 62 advances toward the conveying roll 61, and the sheet bundle is sandwiched by the movable roll 62 and the conveying roll 61. Thereafter, the conveying roll 61 rotationally drives to convey the sheet bundle toward the first stacking part 43.

Note that, the first binding processing device 51 and the second binding processing device 52 are provided to be movable toward an inner side and a front side in FIG. 2, and in the exemplary embodiment, may perform binding processing at plural places of the sheet P on the sheet P.

Figure 3:
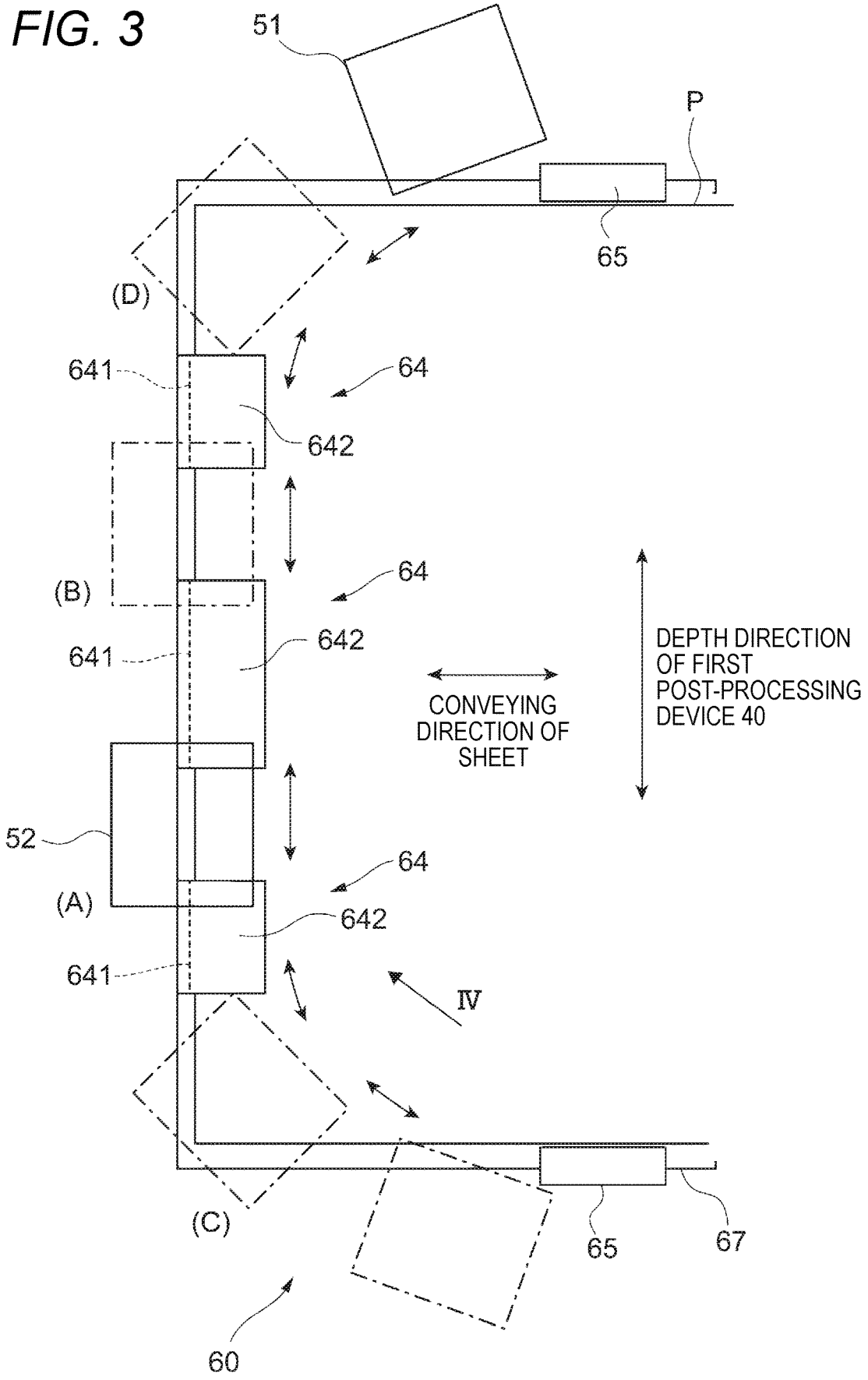
FIG. 3 shows a sheet stacking unit, as seen from above.

Referring to FIG. 3 (showing the sheet stacking unit 60, as seen from above), in the exemplary embodiment, as described above, the first binding processing device 51 and the second binding processing device 52 are provided.

The first binding processing device 51 and the second binding processing device 52 are arranged so that positions in a depth direction of the first post-processing device 40 are different from each other.

In the exemplary embodiment, the first binding processing device 51 and the second binding processing device 52 are configured to move along the depth direction of the first post-processing device 40, which is orthogonal to a conveying direction of the sheet P (sheet bundle).

Additionally describing, in the exemplary embodiment, the first binding processing device 51 and the second binding processing device 52 are configured to move along one common path.

In the exemplary embodiment, the first binding processing device 51 and the second binding processing device 52 are configured to be movable, and may perform binding processing at plural places of the sheet bundle.

Here, the first binding processing device 51 and the binding processing device 52 are each configured to stop at two points ((A) position and (B) position in FIG. 3) located at different places in the depth direction of the first post-processing device 40 and to perform binding processing (two-point end binding processing) at the two points, for example.

Also, the first binding processing device 51 and the binding processing device 52 are each configured to stop at an end of one side of the sheet bundle (a corner portion of one side of the sheet bundle) ((D) position in FIG. 3) and to perform binding processing (one-point end binding) in the stop position, for example.

Also, the first binding processing device 51 and the binding processing device 52 are each configured to stop at an end of the other side of the sheet bundle (a corner portion of the other side of the sheet bundle) ((C) position in FIG. 3) and to perform binding processing (one-point end binding) in the stop position, for example.

Here, in the exemplary embodiment, each of the first binding processing device 51 and the binding processing device 52 linearly moves between the (A) position and the (B) position but moves with rotation of 45°, for example, between the (A) position and the (C) position and between the (B) position and the (D) position.

Here, in the exemplary embodiment, as shown in FIG. 3, the plural end guides 64 is provided.

The end guides 64 are arranged at different places in the depth direction of the first post-processing device 40 (a direction orthogonal to the conveying direction of the sheet P).

As shown in FIG. 3, each of the end guides 64 has a restraint part 641 and a facing piece 642.

The restraint part 641 is arranged orthogonal to the support plate 67. In the exemplary embodiment, an end portion of the sheet P collides with the restraint part 641, so that movement of the sheet P is restrained.

The facing piece 642 connects to the restraint part 641 and is arranged to face the support plate 67.

In the exemplary embodiment, when the sheet P is put on the support plate 67, an end portion of the sheet P enters between the facing piece 642 and the support plate 67. Also, the end portion of the sheet P collides with the restraint part 641. Thereby, the sheet P is aligned neatly.

Note that, when binding processing is performed in the (A) position of FIG. 3, the binding processing is performed through a gap formed between the facing piece 642 positioned at a center (a center in an upper and lower direction) in FIG. 3 and the facing piece 642 positioned at the lower in FIG. 3.

Also, when the binding processing is performed in the (B) position of FIG. 3, the binding processing is performed through a gap formed between the facing piece 642 positioned at the upper in FIG. 3 and the facing piece 642 located at the center in FIG. 3.

Figure 4:
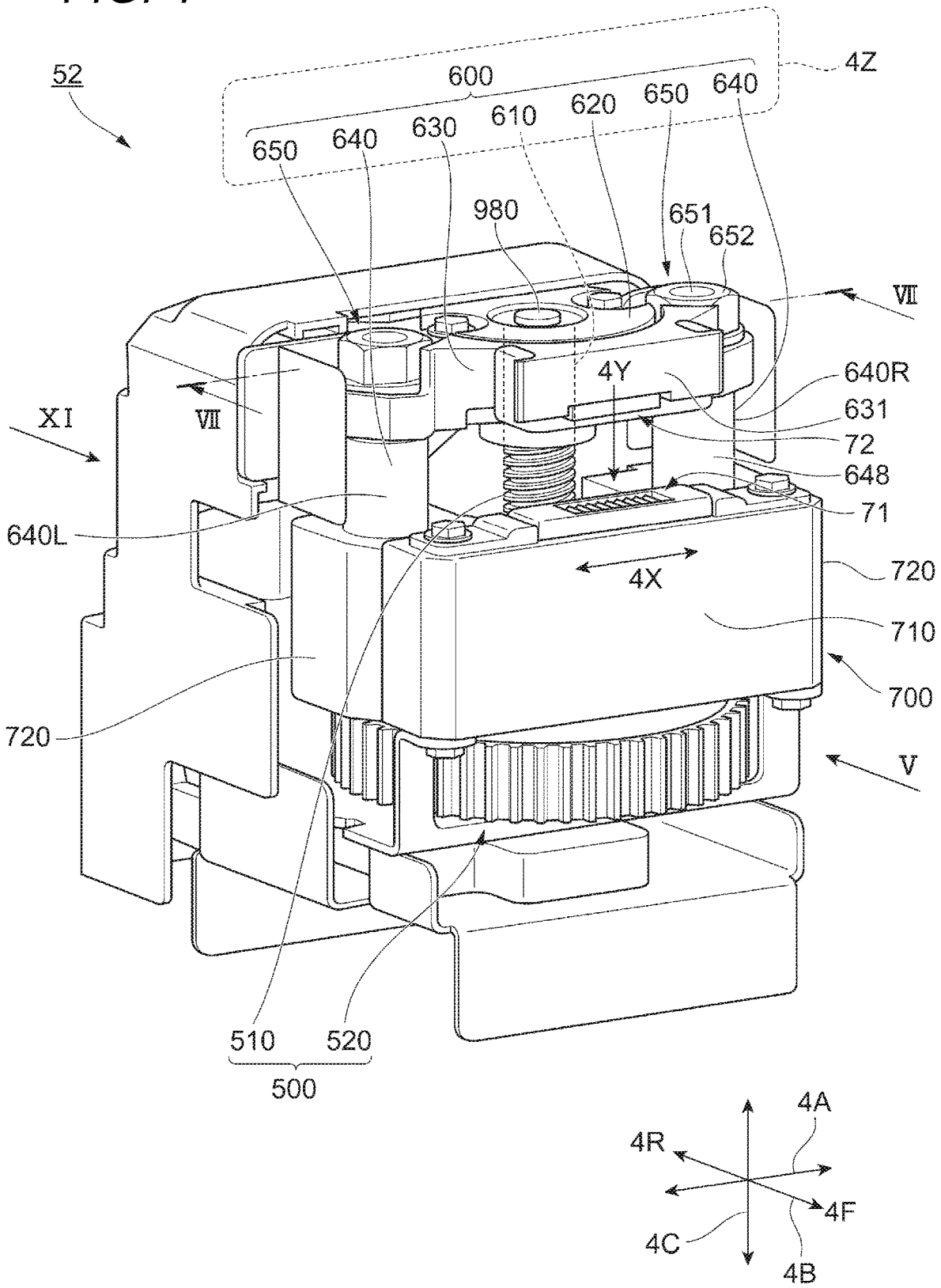
FIG. 4 shows a second binding processing device, as seen from a direction denoted with an arrow IV in FIG. 3.
Figure 5:
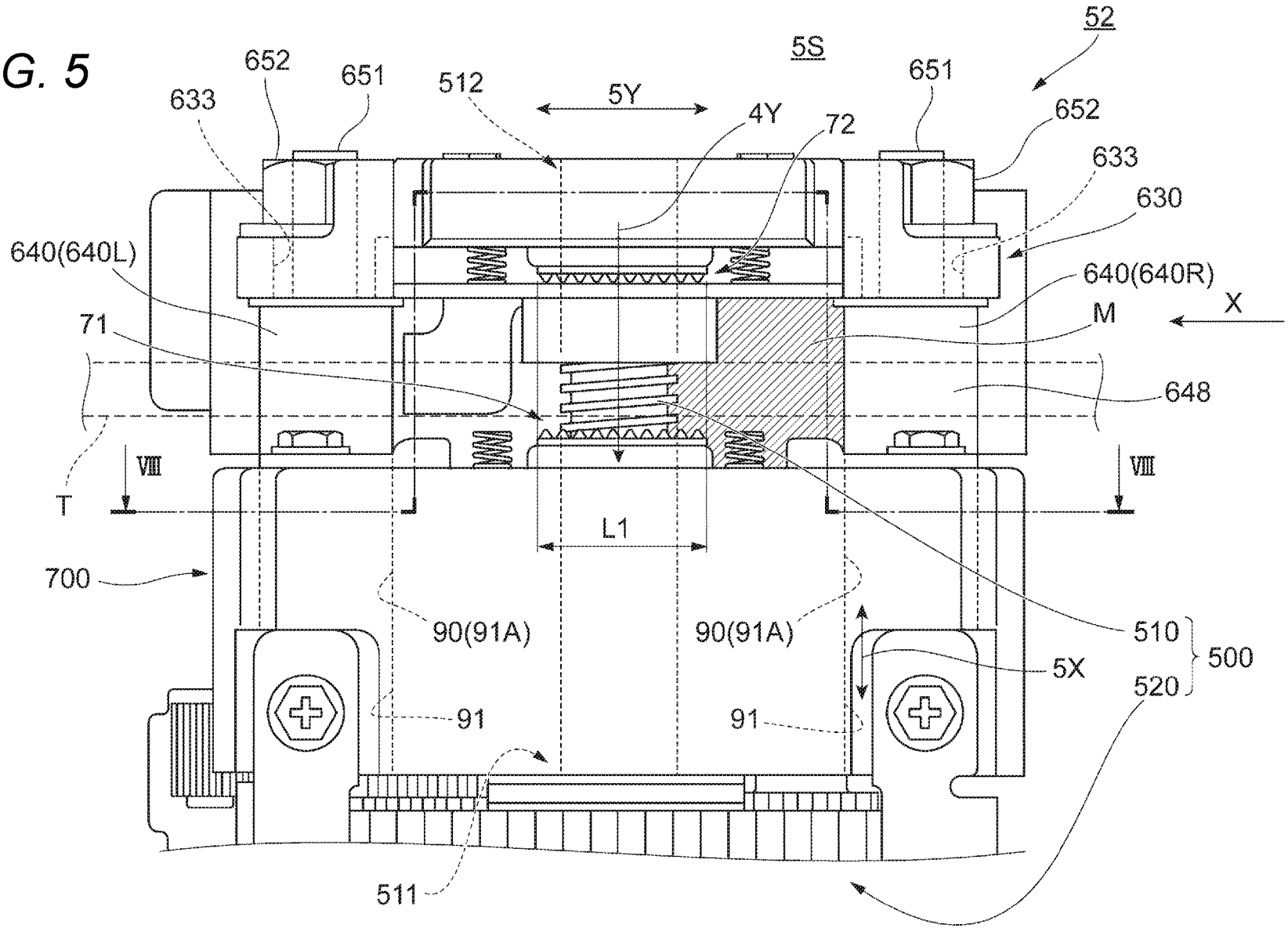
FIG. 5 shows the second binding processing device, as seen from a direction denoted with an arrow V in FIG. 4.

FIG. 4 shows the second binding processing device 52, as seen from a direction denoted with an arrow IV in FIG. 3. FIG. 5 shows the second binding processing device 52, as seen from a direction denoted with an arrow V in FIG. 4. Additionally describing, FIG. 5 shows the second binding processing device 52, as seen from the front.

Note that, in FIG. 4, a direction denoted with an arrow 4A is hereinafter referred to as a width direction of the second binding processing device 52, and a direction denoted with an arrow 4B is referred to as a depth direction of the second binding processing device 52. Also, a direction denoted with an arrow 4C is referred to as a height direction of the second binding processing device 52.

Also, in the present specification, a direction denoted with an arrow 4R is referred to as a rear direction or a rear side, and a direction denoted with an arrow 4F is referred to as a front direction or a front side.

As shown in FIG. 4, the second binding processing device 52 is provided with first binding teeth 71 that are used for binding processing of a sheet bundle T (refer to FIG. 5), which is an example of the recording material bundle. Second binding teeth 72 are provided above the first binding teeth 71.

Each of the first binding teeth 71 as an example of the first teeth and the second binding teeth 72 as an example of the second teeth is provided with an unevenness portion.

A surface of the first binding teeth 71 positioned on the second binding teeth 72-side and a surface of the second binding teeth 72 positioned on the first binding teeth 71-side are each provided with an unevenness portion where a convex portion and a concave portion are alternately aligned in a direction denoted with an arrow 4X in the drawings.

In other words, the surface of the first binding teeth 71 positioned on the second binding teeth 72-side and the surface of the second binding teeth 72 positioned on the first binding teeth 71-side are each provided with an unevenness portion where a convex portion and a concave portion are alternately aligned in a length direction of each of the first binding teeth 71 and the second binding teeth 72.

When the binding processing is performed by the first binding teeth 71 and the second binding teeth 72, the second binding teeth 72 advance toward the first binding teeth 71, in the exemplary embodiment.

More specifically, in the exemplary embodiment, when the binding processing is performed, the second binding teeth 72 move down along a linear path denoted with an arrow 4Y in the drawings (hereinafter, referred to as 'linear path 4Y') and move toward the first binding teeth 71.

In the exemplary embodiment, the sheet bundle T positioned between the first binding teeth 71 and the second binding teeth 72 is sandwiched and pressed by the first binding teeth 71 and the second binding teeth 72.

At this time, in the exemplary embodiment, the convex portions provided to the first binding teeth 71 and the concave portions provided to the second binding teeth 72 face each other. Also, at this time, the concave portions provided to the first binding teeth 71 and the convex portions provided to the second binding teeth 72 face each other.

Further, the convex portions provided to the binding teeth of one side enter the concave portions provided to the binding teeth of the other side.

Thereby, the sheets P constituting the sheet bundle T are pressed and the binding processing of the sheets P is performed. Thereafter, in the exemplary embodiment, the second binding teeth 72 move up and retreat from the first binding teeth 71.

Note that, in the exemplary embodiment, the example where the convex portions and the concave portions are alternately aligned on each of the first binding teeth 71 and the second binding teeth 72 has been described. However, the convex portions and the concave portions may also be arranged in other aligning manners.

Also, for example, when the sheet bundle T is pressed by the first binding teeth 71 and the second binding teeth 72, a part of the sheet bundle T may be cut to form a strip-shaped piece, the sheet bundle T may be formed with a through-hole and the strip-shaped piece may be caused to pass through the through-hole for the binding processing.

The binding processing method by the first binding teeth 71 and the second binding teeth 72 is not particularly limited.

As shown in FIG. 4, the second binding processing device 52 is provided with a moving mechanism 500 as an example of the moving means for moving the second binding teeth 72 toward the first binding teeth 71.

The moving mechanism 500 has a rod-shaped screw member 510 extending in the upper and lower direction in FIG. 4, and is configured to rotate the screw member 510 in a circumferential direction, thereby moving the second binding teeth 72 toward the first binding teeth 71.

The screw member 510 is made of metal. The screw member 510 is formed straight.

An outer peripheral surface of the screw member 510 is formed with spiral convex portions and groove portions. In other words, the outer peripheral surface of the screw member 510 is provided with a male screw where convex and groove portions are aligned at predetermined constant intervals in an axis direction of the screw member 510. The convex portions and the groove portions are alternately arranged in the axis direction of the screw member 510.

The screw member 510 of the exemplary embodiment is a screw conforming to JIS standards.

The type of the screw member 510 is not particularly limited. However, for example, a trapezoidal screw is used. The screw member 510 is not limited to the configuration where the screw alone is provided, and may be integrated with a member having another function.

The screw member 510 is arranged along the linear path 4Y along which the second binding teeth 72 move.

In the exemplary embodiment, a multiple thread screw is used as the screw member 510. More specifically, in the exemplary embodiment, a two-thread screw is used as the screw member 510.

In the exemplary embodiment, "multiple thread screw" indicates a screw where there are two or more threads in one pitch.

Also, in the exemplary embodiment, an interlocking part 600 configured to move in conjunction with the second binding teeth 72 is provided. The screw member 510 is in mesh with the interlocking part 600. In other words, the screw member 510 is connected to the interlocking part 600.

More specifically, the interlocking part 600 is provided with a female thread part 610, and the screw member 510 that is a male screw is in mesh with a part of the interlocking part 600 where the female thread part 610 is provided.

The moving mechanism 500 is configured to rotate the screw member 510 in mesh with the female thread part 610 in the circumferential direction, thereby moving the second binding teeth 72 toward the first binding teeth 71.

More specifically, in the exemplary embodiment, when a drive motor M, which will be described later, is rotated in a forward direction, the screw member 510 rotates in the circumferential direction and in one direction.

Thereby, the interlocking part 600 and the second binding teeth 72 move down, and the second binding teeth 72 move toward the first binding teeth 71. Thereby, the binding processing is performed.

In the exemplary embodiment, when the screw member 510 rotates in the circumferential direction, the interlocking part 600 and the second binding teeth 72 move along the axis direction of the screw member 510.

In the exemplary embodiment, when the binding processing is over, the drive motor M rotates in a reverse direction, so that the screw member 510 rotates in the reverse direction.

Thereby, the interlocking part 600 and the second binding teeth 72 move up. When the second binding teeth 72 move up, the second binding teeth 72 retreat from the first binding teeth 71.

As shown in FIG. 5, the moving mechanism 500 is provided with the drive motor M as an example of the drive source, in addition to the screw member 510.

In the exemplary embodiment, a pinion gear (not shown) connected to an output shaft of the drive motor M and arranged coaxially with the output shaft is provided below the drive motor M. Also, a rotation gear (not shown) configured to rotate in mesh with the pinion gear is provided.

Further, in the exemplary embodiment, as shown in FIG. 4, a large-diameter gear 520 in mesh with the rotation gear and configured to receive a drive force from the rotation gear is provided.

The large-diameter gear 520 as an example of the rotary body is arranged coaxially with the screw member 510.

In the exemplary embodiment, a lower end portion of the screw member 510 is fixed to the large-diameter gear 520. In the exemplary embodiment, an outer diameter of the large-diameter gear 520 is larger than an outer diameter of the screw member 510.

In the exemplary embodiment, the large-diameter gear 520 is rotated by the drive motor M and the screw member 510 is accordingly rotated in the circumferential direction.

In the exemplary embodiment, the large-diameter gear 520 is configured to receive a drive force that is transmitted to the screw member 510. Then, the drive force is transmitted from the large-diameter gear 520 to the screw member 510.

Thereby, the screw member 510 is rotated about an axis center. When the screw member 510 is rotated about the axis center, the second binding teeth 72 is advanced and retreated with respect to the first binding teeth 71.

A mechanism for moving the second binding teeth 72 is not particularly limited. For example, a cam mechanism and a jack mechanism may also be used. Here, when the screw member 510 is used, like the exemplary embodiment, the second binding processing device 52 may be made small.

When using a cam mechanism or a jack mechanism, it is considered to provide a cam mechanism or a jack mechanism at a place (above the second binding processing device 52) denoted with a reference sign 4Z in FIG. 4, for example.

In this aspect, the interlocking part 600 is pressed from above by the cam mechanism or jack mechanism, thereby moving the second binding teeth 72.

On the other hand, in this case, it is difficult to increase a spaced amount between the first binding teeth 71 and the second binding teeth 72 while suppressing enlargement of the second binding processing device 52.

In the exemplary embodiment, a space between the first binding teeth 71 and the second binding teeth 72 is an accommodation part for accommodating the sheet bundle T. However, when a cam mechanism or a jack mechanism is used, it is difficult to make the accommodation part large while suppressing enlargement of the second binding processing device 52.

When using a cam mechanism or a jack mechanism, if the cam mechanism or jack mechanism is made large, advance and retreat mounts of the second binding teeth 72 increase, so that it is possible to make the accommodation part large. In this case, however, the second binding processing device 52 is enlarged.

Also, when the accommodation part is made small, the enlargement of the second binding processing device 52 may be suppressed. However, in this case, the maximum number of sheets P that may be subjected to the binding processing becomes small.

In contrast, when the screw member 510 is used, like the exemplary embodiment, enlargement of the second binding processing device 52 is suppressed and the accommodation part is made larger.

Particularly, in the exemplary embodiment, as shown in FIG. 5, some configurations of the moving mechanism 500 such as the drive motor M, the screw member 510 and the like are provided on a side of the linear path 4Y along which the second binding teeth 72 move.

In this case, while reducing a size in the height direction of the second binding processing device 52, it is easy to secure a size of the accommodation part.

Also, in the exemplary embodiment, as shown in FIG. 4, the large-diameter gear 520 is arranged to extend in a direction of intersecting with the linear path 4Y along which the second binding teeth 72 move. Also with this configuration, the size in the height direction of the second binding processing device 52 is reduced.

In the exemplary embodiment, the extension direction of the linear path 4Y and a radial direction of the large-diameter gear 520 intersect with each other (orthogonal to each other).

In this case, as compared to a configuration where the large-diameter gear 520 is provided along the extension direction of the linear path 4Y, the size in the height direction of the second binding processing device 52 is reduced.

Also, in the exemplary embodiment, the second binding processing device 52 may pass through the end guides 64 shown in FIG. 3.

More specifically, in the exemplary embodiment, the maximum spaced amount between the first binding teeth 71 and the second binding teeth 72 is set larger than the height sizes of the end guides 64, and the end guides 64 pass through the accommodation part. Thereby, the second binding processing device 52 may pass through the end guides 64.

As shown in FIG. 4, the interlocking part 400 is provided with a load receiving member 620. In the exemplary embodiment, the load receiving member 620 is provided with the female thread part 610.

The load receiving member 620 as an example of the load receiving part is in contact with the screw member 510 and is configured to receive a load from the screw member 510.

The interlocking part 600 is also provided with an upper support member 630 configured to support the load receiving member 620 and the second binding teeth 72.

In addition, the interlocking part 600 is provided with two rod-shaped members 640 attached to the upper support member 630 and extending downward. Further, the interlocking part 600 is provided with a fixing member 650 for fixing each of the rod-shaped members 640 to the upper support member 630.

In the exemplary embodiment, a left rod-shaped member 640L positioned on the left in the drawings and a right rod-shaped member 640R positioned on the right in the drawings are provided as the rod-shaped members 640.

Each of the left rod-shaped member 640L and the right rod-shaped member 640R is arranged to extend along the linear path 4Y.

The rod-shaped members 640 are used to guide the interlocking part 600. Also, the rod-shaped members 640 are used to guide the second binding teeth 72.

In the exemplary embodiment, an outer diameter of each of the rod-shaped members 640 is larger than an outer diameter of the screw member 510. More specifically, an outer diameter of each of the left rod-shaped member 640L and the right rod-shaped member 640R is larger than the outer diameter of the screw member 510.

Also, in the exemplary embodiment, the upper support member 630 and the rod-shaped members 640 are separate components, and the rod-shaped members 640 are attached to the upper support member 630.

However, the present invention is not limited thereto. For example, the upper support member 630 and the rod-shaped members 640 may be integrated, and the upper support member 630 may be provided with a function of the rod-shaped members 640.

The fixing member 650 is constituted by a nut 652.

A tip end portion of the rod-shaped member 640, which is positioned at the upper in the drawings, is provided with a bolt portion 651, and the nut 652 is fixed to the bolt portion 651.

In addition, in the exemplary embodiment, a part of the rod-shaped member 640 positioned below the upper support member 630 is provided with a cylindrical rod-shaped member body 648.

In the exemplary embodiment, the upper support member 630 is formed with through-holes 633 (refer to FIG. 5) as an example of the hole portion.

In the exemplary embodiment, the rod-shaped member 640 passes through the through-hole 633. In the exemplary embodiment, as shown in FIG. 5, the bolt portion 651 of the rod-shaped member 640 protrudes upward beyond the upper support member 630.

In the exemplary embodiment, as shown in FIG. 5, the nut 652 is fastened to the bolt portion 651 protruding upward beyond the upper support member 630.

Further, in the exemplary embodiment, the upper support member 630 is sandwiched by the nut 652 fastened to the bolt portion 651 and the rod-shaped member body 648 of the rod-shaped member 640. Thereby, the rod-shaped member 640 is fixed to the upper support member 630.

Further, in the exemplary embodiment, as shown in FIG. 4, the second binding teeth 72 are fixed to the upper support member 630. More specifically, in the exemplary embodiment, the second binding teeth 72 are fixed to one end portion 631 of the upper support member 630 positioned on the front side in FIG. 4.

More specifically, in the exemplary embodiment, the second binding teeth 72 are fixed to the upper support member 630 by press-fitting.

Note that, the fixing of the second binding teeth 72 is not limited to the press-fitting and may also be made by other methods such as bonding, welding, fastening and the like.

A lower support member 700 configured to support the first binding teeth 71 is provided below the interlocking part 600. In other words, the lower support member 700 configured to support the first binding teeth 71 is provided below the upper support member 630.

In the exemplary embodiment, the first binding teeth 71 are fixed to the lower support member 700 by press-fitting.

Note that, like the above, the fixing of the first binding teeth 71 is not limited to the press-fitting and may also be made by other methods such as bonding, welding, fastening and the like.

The lower support member 700 is provided with a teeth support part 710 extending in the width direction of the second binding processing device 52 and configured to support the first binding teeth 71 from below.

The lower support member 700 is also provided with connection parts 720 connected to each of end portions of the teeth support part 710 and facing from the end portions toward the rear side of the second binding processing device 52.

In the exemplary embodiment, as described later, the lower support member 700 is formed by a metallic block, and is integrated with the teeth support part 710 and the connection parts 720.

Further, in the exemplary embodiment, as shown in FIG. 5, guide parts 90 for guiding the second binding teeth 72 are provided.

The guide parts 90 are provided to the lower support member 700. The guide parts 90 are arranged along the linear path 4Y along which the second binding teeth 72 move.

In the exemplary embodiment, as described above, the rod-shaped members 640 are provided, and the guide parts 90 are configured to guide the rod-shaped members 640, thereby guiding the second binding teeth 72.

More specifically, in the exemplary embodiment, the lower support member 700 is provided with hole portions 91 extending along the linear path 4Y.

In the exemplary embodiment, the guide part 90 is constituted by an inner peripheral surface 91A of the hole portion 91.

In the exemplary embodiment, the inner peripheral surface 91A of the hole portion 91 is used to guide the rod-shaped member 640 as an example of the guided part.

Note that, in the exemplary embodiment, a cylindrical member 198 (refer to FIG. 13) is inserted in each of the hole portions 91, and the inner peripheral surface 91A (refer to FIG. 5) of the hole portion 91 is configured to guide the rod-shaped member 640 via the cylindrical member 198.

Note that, the present invention is not limited thereto. For example, the inner peripheral surface 91A of the hole portion 91 may be in direct contact with the outer peripheral surface of the rod-shaped member 640, without the cylindrical member 198.

The configuration "the inner peripheral surface 91A of the hole portion 91 guides the rod-shaped member 640" is not limited to the aspect where the inner peripheral surface 91A guides the rod-shaped member 640 with being in direct contact with the rod-shaped member 640, and includes an aspect where the inner peripheral surface 91A guides the rod-shaped member 640 via another member such as the cylindrical member 198.

In the exemplary embodiment, the guide part 90 and the rod-shaped member 640 as an example of the guided part are each provided in plural. Specifically, in the exemplary embodiment, the guide part 90 and the rod-shaped member 640 are each provided by two.

Note that, in the exemplary embodiment, as described above, although the guided part and the guide part are each provided by two, the numbers of the guided parts and the guide parts are not limited thereto, and may be one or may be three or more.

The hole portion 91 has a circular section. In the exemplary embodiment, the rod-shaped member 640 is constituted by a columnar member of $\phi$10 mm or larger.

Note that, the sectional shape of the hole portion 91 and the sectional shape of the rod-shaped member 640 are not limited to the circular shape, and may also be a shape other than the circular shape, such as an elliptical shape and a polygonal shape.

In the exemplary embodiment, the columnar rod-shaped member 640 constituting a part of the interlocking part 600 (refer to FIG. 4) is inserted in the hole portion 91, and the rod-shaped member 640 is guided by the inner peripheral surface 91A of the hole portion 91.

In the exemplary embodiment, the guide part 90 is constituted by the hole portion 91 that is an example of the hole provided in the lower support member 700. More specifically, the guide part 90 is constituted by an inner surface of the hole portion 91 provided in the lower support member 700.

The guide part 90 is configured to guide the outer surface of the rod-shaped member 640 by using the inner surface of the hole portion 91.

The rod-shaped member 640 (refer to FIG. 4) as an example of the guided part and the rod-shaped part extends in the upper and lower direction that is a moving direction of the interlocking part 600. In other words, the rod-shaped member 640 extends along the moving path of the interlocking part 600.

Also, the rod-shaped member 640 extends towards a downstream side with respect to the moving direction of the interlocking part 600, when a connection place with the upper support member 630 is set as a starting point.

Further, in the exemplary embodiment, the hole portion 91 (refer to FIG. 5) provided in the lower support member 700 and functioning as the guide part also extends along the moving path of the interlocking part 600.

Note that, in FIGS. 4 and 5, the guide part is constituted by the inner surface of the hole, and the guided part is constituted by the rod-shaped part in contact with the inner surface of the hole. However, the present invention is not limited thereto. For example, as described later, the guided part may be constituted by the inner surface of the hole, and the guide part may be constituted by the rod-shaped part in contact with the inner surface of the hole.

Also, the hole portion 91 (refer to FIG. 5) provided in the lower support member 700 may be formed to penetrate through the lower support member 700. The present invention is not limited thereto. For example, the hole portion 91 does not penetrate through the lower support member 700, and the hole portion 91 having a bottom may be provided.

In the exemplary embodiment, as the second binding teeth 72 move toward the first binding teeth 71, a contact area between the guide part 90 (refer to FIG. 5) and the rod-shaped member 640, which is the guided part, increases.

More specifically, in the exemplary embodiment, as the second binding teeth 72 move toward the first binding teeth 71, an advance amount of the rod-shaped member 640 into the hole portion 91 increases and the contact area between the guide part 90 and the rod-shaped member 640 increases.

In other words, in the exemplary embodiment, as the second binding teeth 72 move toward the first binding teeth 71, an area of an overlapping region of the guide part 90 and the rod-shaped member 640 increases.

Figure 6:
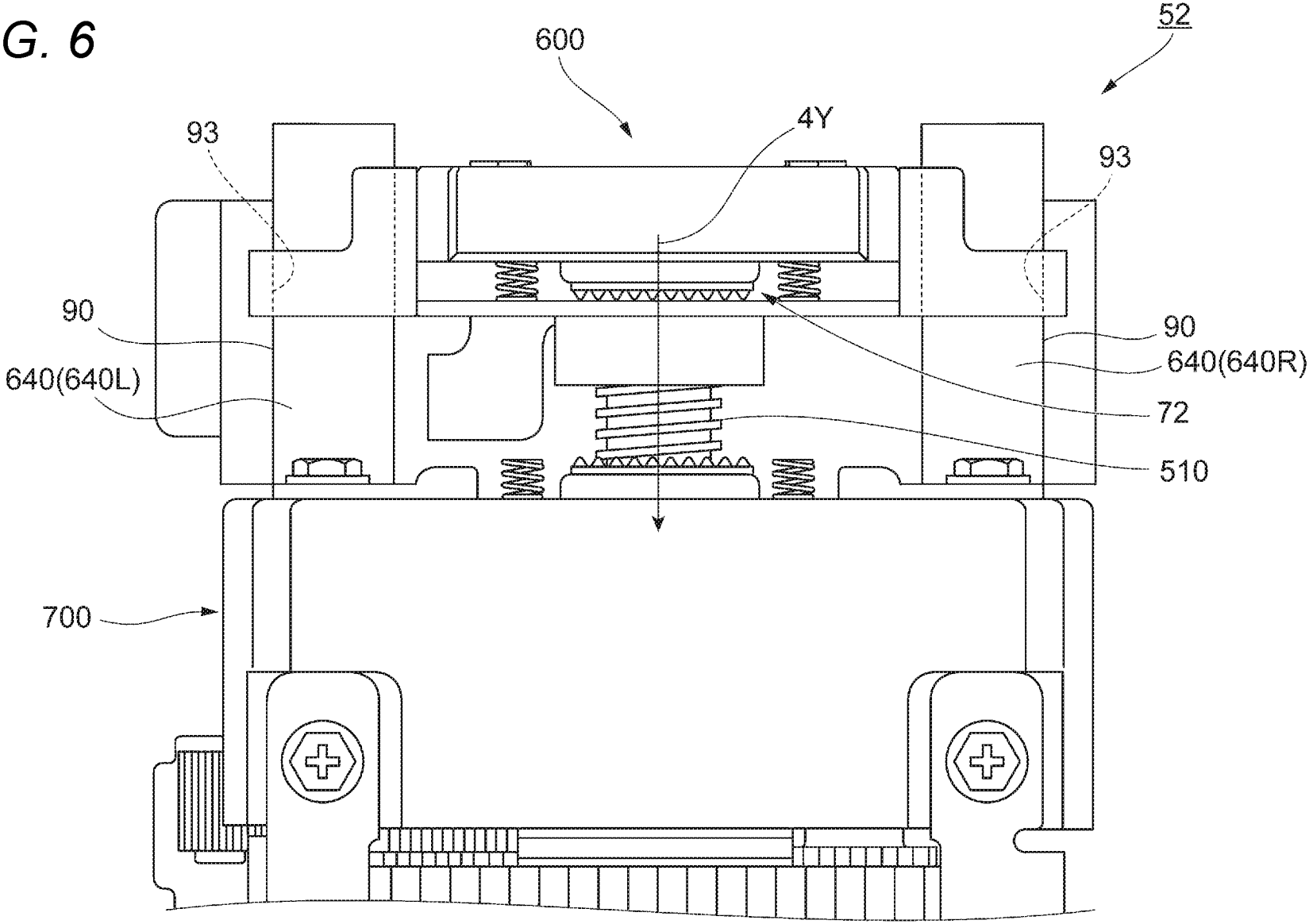
FIG. 6 shows another configuration example of the second binding processing device.

FIG. 6 shows another configuration example of the second binding processing device 52.

FIG. 6 shows an example where the guided part is constituted by the inner surface of the hole and the guide part is constituted by the rod-shaped part in contact with the inner surface of the hole.

In this configuration example, a hole portion 93 extending along the linear path 4Y is provided on the interlocking part 600-side configured to interlock with the second binding teeth 72.

Also, in this configuration example, the lower support member 700 is provided with the rod-shaped members 640 entering the hole portions 93 and extending along the linear path 4Y. The rod-shaped members 640 are fixed to the lower support member 700.

In this configuration example, an outer peripheral surface of the rod-shaped member 640 becomes the guide part 90, and the outer peripheral surface is used to guide the interlocking part 600.

In this configuration example, the guided part is constituted by the inner surface of the hole portion 93 extending along the moving direction of the interlocking part 600.

Also, in this configuration example, the guide part is constituted by the rod-shaped member 640 extending along the moving direction of the interlocking part 600 and in contact with the inner surface of the hole portion 93.

Also, in the exemplary embodiment (the embodiment shown in FIGS. 4 and 5), as movement of the screw member 510 relative to the interlocking part 600, the screw member 510 may be moved in the direction of intersecting with (orthogonal to) the extension direction of the screw member 510.

Specifically, in the exemplary embodiment, as movement of the screw member 510 relative to the interlocking part 600, the screw member 510 may be moved in a direction denoted with an arrow 4A in FIG. 4.

In other words, the screw member 510 may be moved in the width direction of the second binding processing device 52.

In the exemplary embodiment, the load receiving member 620 may be moved in the direction denoted with the arrow 4A.

More specifically, in the exemplary embodiment, the load receiving member 620 may be moved relative to the upper support member 630. Thereby, the load receiving member 620 may be moved in the width direction of the second binding processing device 52.

In other words, in the exemplary embodiment, the load receiving member 620 may be moved relative to the upper support member 630 and the rod-shaped members 640 constituting parts of the interlocking part 600.

In this way, when the load receiving member 620 may be moved relative to the upper support member 630 and the rod-shaped members 640, the screw member 610 may be moved relative to the upper support member 630 and the rod-shaped members 640.

More specifically, as movement of the screw member 510 relative to the upper support member 630 and the rod-shaped members 640, the screw member 510 may be moved in the direction of intersecting with (orthogonal to) the extension direction of the screw member 510.

In other words, the screw member 510 may be moved in the radial direction of the screw member 510.

Figure 7:
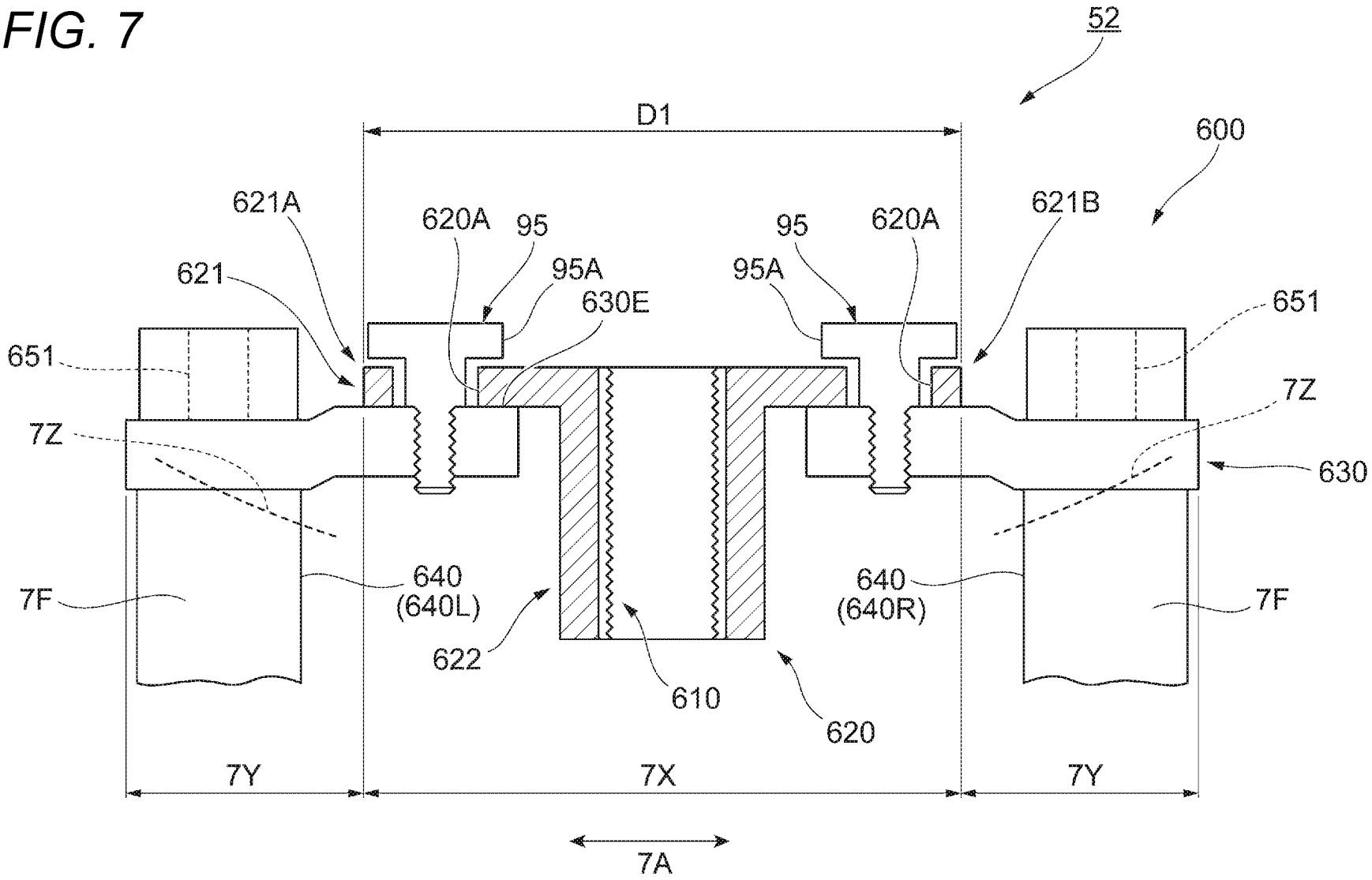
FIG. 7 is a sectional view of the second binding processing device taken along a VII-VII line in FIG. 4.

FIG. 7 is a sectional view of the second binding processing device 52 taken along a VII-VII line of FIG. 4, showing an upper part of the second binding processing device 52.

In the exemplary embodiment, as shown in FIG. 7, the load receiving member 620 is formed with a through-hole 620A, and a fixing screw 95 that is used for fixing the load receiving member 620 to the upper support member 630 passes through the through-hole 620A.

A gap is formed between an inner peripheral surface of the through-hole 620A and the fixing screw 95. An outer peripheral surface of a part, which is positioned inside the through-hole 620A, of the fixing screw 95 is not provided with a thread portion.

A thickness of the load receiving member 620 is set smaller than a spaced distance between a head portion 95A of the fixing screw 95 and an upper surface 630E of the upper support member 630.

Thereby, in the exemplary embodiment, as movement of the load receiving member 620 relative to the upper support member 630, the load receiving member 620 may be moved in a direction denoted with an arrow 7A in FIG. 7.

In this case, the screw member 510 (not shown in FIG. 7) may be moved relative to the upper support member 630 and the rod-shaped members 640.

In other words, as movement of the screw member 510 relative to the interlocking part 600 (refer to FIG. 4), the screw member 510 may be moved in the direction of intersecting with the extension direction of the screw member 510.

Here, for example, a configuration is assumed in which the screw member 510 maynot move relative to the interlocking part 600 and the screw member 510 is inclined with respect to the linear path 4Y (refer to FIG. 4).

In this case, when the second binding teeth 72 advance and retreat with respect to the first binding teeth 71, the second binding teeth 72 are directed toward a position different from the original position. In this case, the position of the second binding teeth 72 relative to the first binding teeth 71 deviates from an originally expected position.

In contrast, when the screw member 510 may be moved, like the exemplary embodiment, an inclination of the screw member 510 with respect to the linear path 4Y becomes smaller, so that the deviation of the second binding teeth 72 with respect to the first binding teeth 71 becomes smaller.

Also, if the screw member 510 maynot move relative to the interlocking part 600 and the screw member 510 is inclined with respect to the linear path 4Y, while the second binding teeth 71 is moving toward the first binding teeth 71, the second binding teeth 72 may stop, and therefore, the binding maynot be performed.

In contrast, when the screw member 510 may be moved, like the exemplary embodiment, the inclination of the screw member 510 with respect to the linear path 4Y becomes smaller. As a result, the malfunction that the second binding teeth 72 stop on the way is difficult to occur.

In the exemplary embodiment, a part denoted with a reference sign 7F in FIG. 7 is the guided part that is guided by the guide part 90 (refer to FIG. 5), and the load receiving member 620 may be moved relative to the guided part.

More specifically, as movement relative to the guided part, the load receiving member 620 may be moved in a direction of intersecting with (orthogonal to) an axis direction of the screw member 510 (not shown, in FIG. 7).

The interlocking part 600 includes the load receiving member 620 as an example of the load receiving part in contact with the screw member 510 and configured to receive a load from the screw member 510, and the rod-shaped members 640 as an example of the guided parts that are guided by the guide parts 90.

In the exemplary embodiment, the load receiving member 620 as an example of the load receiving part may be moved relative to the rod-shaped members 640.

When the load receiving member 620 may be moved relative to the rod-shaped members 640, like the exemplary embodiment, the deviation of the second binding teeth 72 with respect to the first binding teeth 71 becomes smaller, and the malfunction that the second binding teeth 72 stop on the way is difficult to occur, as described above.

As shown in FIG. 7, the load receiving member 620 has a T-shaped section.

More specifically, the load receiving member 620 has a disc-shaped large-diameter part 621 positioned at the upper in FIG. 7, and a small-diameter part 622 positioned below the large-diameter part 621.

The large-diameter part 621 and the small-diameter part 622 are coaxially arranged. Also, a lower end portion of the large-diameter part 621 and an upper end portion of the small-diameter part 622 are connected.

The female thread part 610 is provided on a central axis of the load receiving member 620.

The female thread part 610 has a tubular shape. In the exemplary embodiment, the rod-shaped screw member 510 (refer to FIG. 4) passes through the female thread part 610. In other words, in the exemplary embodiment, the female thread part 610 and the screw member 510 mesh with each other and connect to each other.

Also, in the exemplary embodiment, a length L1 (refer to FIG. 5) in the length direction of the second binding teeth 72 is smaller than an outer diameter D1 (refer to FIG. 7) of the large-diameter part 621.

In addition, in the exemplary embodiment, when comparing positions in a radial direction of the large-diameter part 621, the second binding teeth 72 (refer to FIG. 5) are positioned closer to the other end 621B than one end 621A (refer to FIG. 7) of the large-diameter part 621.

Also, the second binding teeth 72 are positioned closer to one end 621A than the other end 621B of the large-diameter part 621.

In other words, in the exemplary embodiment, when seeing the second binding processing device 52 from the front (when seeing the second binding processing device 52 from a side on which the receiving part is provided), the second binding teeth 72 are positioned between one end 621A and the other end 62B of the large-diameter part 621.

In the exemplary embodiment, the load receiving member 620 is pulled downward by the screw member 510, and a part denoted with a reference sign 7X of the upper support member 630 is accordingly equally pressed from above by the load receiving member 620.

In this case, the equally pressed part of the upper support member 630 is moved downward while substantially maintaining a shape extending laterally and linearly.

Note that, side parts (parts denoted with a reference sign 7Y in FIG. 7) of the upper support member 630 positioned on both sides of the pressed part are likely to be inclined with respect to the horizontal direction, as shown with a reference sign 7Z.

In this case, for example, when a size in the length direction of the second binding teeth 72 is large and some of the second binding teeth 72 are configured to reach the side parts (parts denoted with the reference sign 7Y), the second binding teeth 72 are likely to be deformed.

In contrast, like the exemplary embodiment, when the second binding teeth 72 do not reach the side parts and the second binding teeth 72 are positioned between one end 621A and the other end 621B of the large-diameter part 621, the second binding teeth 72 are difficult to be deformed.

Also, in the exemplary embodiment, as movement of the second binding teeth 72 relative to the guide parts 90 (refer to FIG. 5), the second binding teeth 72 may be moved in the direction of intersecting with the extension direction of the guide parts 90.

More specifically, in the exemplary embodiment, the second binding teeth 72 may be moved in a direction of intersecting with a direction denoted with an arrow 5X (refer to FIG. 5), which is the extension direction of the inner peripheral surface 91A of the hole portion 91.

Additionally describing, in the exemplary embodiment, the second binding teeth 72 may be moved in a direction of intersecting with an advance and retreat direction of the second binding teeth 72.

Also, in the exemplary embodiment, the upper support member 630 may be moved in the direction denoted with an arrow 5Y in FIG. 5.

More specifically, in the exemplary embodiment, the upper support member 630 may be moved relative to the rod-shaped members 640, and the upper support member 630 may be moved in the direction denoted with the arrow 5Y.

In other words, in the exemplary embodiment, the upper support member 630 may be moved along the length direction of the second binding teeth 72.

In the exemplary embodiment, the second binding teeth 72 are moved in the length direction by moving the upper support member 630 relative to the rod-shaped members 640.

Additionally describing, in the exemplary embodiment, when the upper support member 630 is moved relative to the rod-shaped members 640, the second binding teeth 72 are moved in the direction of intersecting with the extension direction (the direction denoted with the arrow 5Y in the drawings) of the guide parts 90.

More specifically, in the exemplary embodiment, as shown in FIG. 5, the upper end portions of the rod-shaped members 640 are provided with the bolt portions 651.

Also, in the exemplary embodiment, the upper support member 630 is formed with the through-holes 633 through which the bolt portions 651 pass. The through-hole 633 is a so-called long hole and is formed to extend along the length direction of the second binding teeth 72.

Thereby, in the exemplary embodiment, the upper support member 630 may be moved relative to the rod-shaped members 640, and the second binding teeth 72 may be moved in the direction of intersecting with the extension direction of the rod-shaped members 640. In other words, the second binding teeth 72 may be moved in the direction of intersecting with the extension direction of the guide parts 90.

More specifically, the second binding teeth 72 may be moved in the direction shown with the arrow 5Y in FIG. 5.

In the exemplary embodiment, the fixed state of the rod-shaped members 640 to the upper support member 630 by the bolt portions 651 and the nuts 652 is released, and the upper support member 630 is then moved in the length direction of the second binding teeth 72.

Thereby, a positional relationship between the first binding teeth 71 and the second binding teeth 72 is changed. Additionally describing, the relative position of the second binding teeth 72 to the first binding teeth 71 is adjusted.

Note that, in the exemplary embodiment, when the position adjusting of the second binding teeth 72 is ended, the nuts 652 are fastened to the bolt portions 651, so that the rod-shaped members 640 are fixed to the upper support member 630.

Note that, in the exemplary embodiment, the upper support member 630 is configured to move in the length direction of the second binding teeth 72. However, the present invention is not limited thereto. For example, the upper support member 630 may also be configured to move in both the length direction of the second binding teeth 72 and the direction orthogonal to the length direction.

Note that, in order to enable the upper support member 640 to move in both the length direction and the direction orthogonal to the length direction, for example, the through-holes 633 formed in the upper support member 630 are formed by circular holes each having a diameter larger than the outer diameter of the bolt portion 651.

Thereby, the upper support member 630 may be moved in both the length direction and the direction orthogonal to the length direction.

Also, in the exemplary embodiment, as shown in FIG. 5, the drive motor M is positioned between one end 511 and the other end 512 in the axis direction of the screw member 510. In other words, in the exemplary embodiment, the drive motor M is positioned on a side of the screw member 510.

Thereby, in the exemplary embodiment, the size of the second binding processing device 52 is reduced in the extension direction of the screw member 510, in other words, the advance and retreat direction of the second binding teeth 72.

Here, if the drive motor M is positioned at a place denoted with a reference sign 5S in FIG. 5, for example, the second binding processing device 52 is likely to be enlarged.

In contrast, like the exemplary embodiment, when the drive motor M is positioned on a side of the screw member M, the enlargement of the second binding processing device 52 is suppressed.

In the exemplary embodiment, the drive motor M is entirely or mostly positioned between one end 511 and the other end 512 in the axis direction of the screw member 510.

Note that, the present invention is not limited thereto. For example, at least a part of the drive motor M may be positioned closer to the other end 512 than one end 511 and closer to one end 511 than the other end 512 in the axis direction of the screw member 510.

In this case, as compared to a configuration where the drive motor M is not positioned at all between one end 511 and the other end 512, the second binding processing device 52 may be made smaller.

Figure 8:
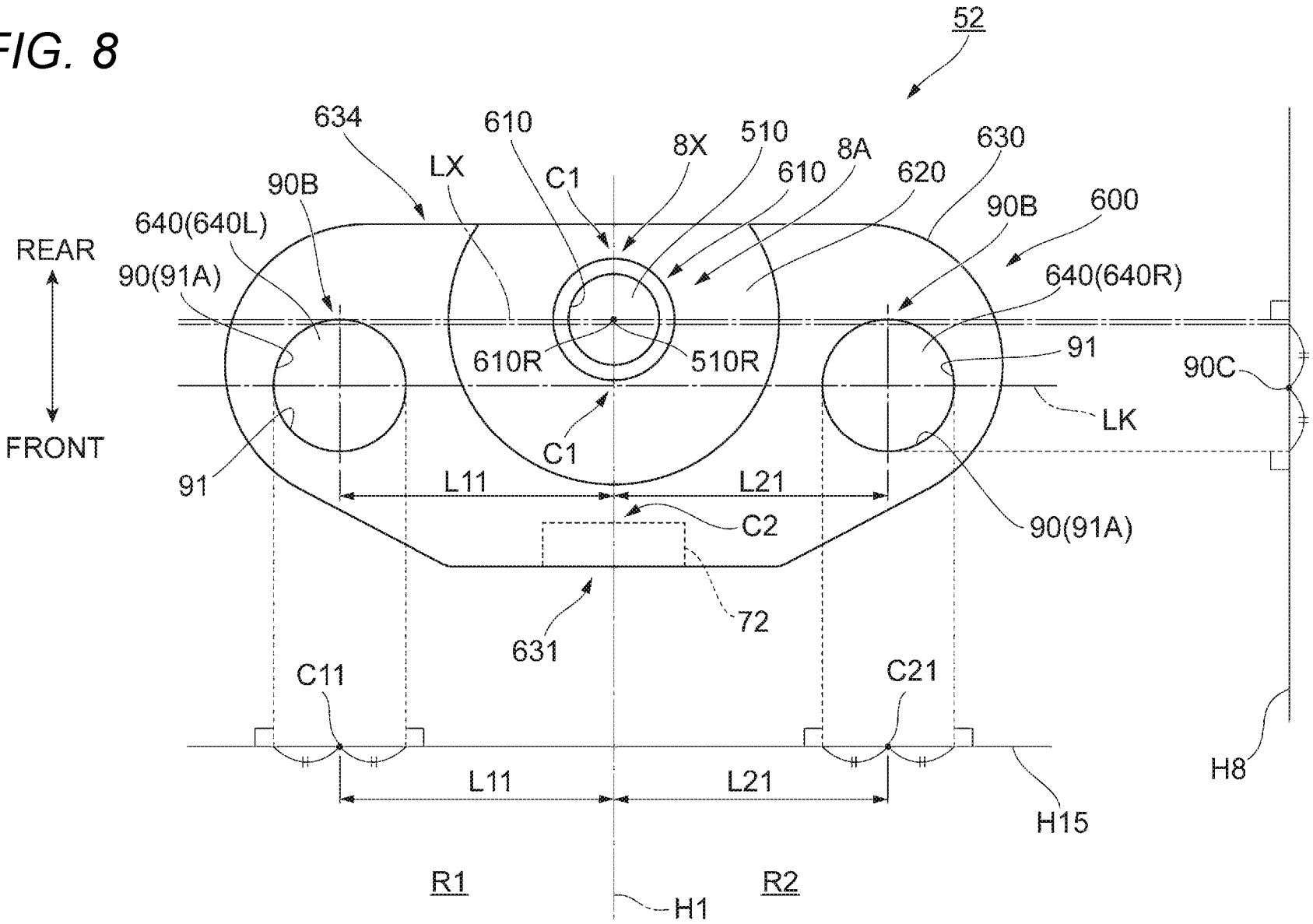
FIG. 8 is a sectional view of the second binding processing device taken along a VIII-VIII line in FIG. 5.

FIG. 8 is a sectional view of the second binding processing apparatus 52 taken along a VIII-VIII line in FIG. 5.

In the exemplary embodiment, the moving mechanism 500 (refer to FIG. 4) is configured to apply a load to a specific place of the interlocking part 600, thereby moving the second binding teeth 72 toward the first binding teeth 71.

More specifically, the moving mechanism 500 is configured to apply a load to a specific place (hereinafter, referred to as 'load-applied place 8A') denoted with a reference sign 8A of the interlocking part 600, thereby moving the second binding teeth 72 toward the first binding teeth 71.

More specifically, in the exemplary embodiment, the load-applied place 8A is a place where the female thread part 610 is provided. In the exemplary embodiment, a load is applied to the place where the female thread part 610 is provided, thereby moving the interlocking part 600 to move the second binding teeth 72 toward the first binding teeth 71.

In the exemplary embodiment, the guide part 90 (the inner peripheral surface 91A of the hole portion 91) is positioned on a side closer to the second binding teeth 72 than the load-applied place 8A.

Note that, the description "positioned on a side closer' does not mean that all portions of the guide part 90 are positioned on a side closer to the second binding teeth 72 than the load-applied place 8A.

In the exemplary embodiment, a rear-side portion 90B, which is positioned on the most rear side, of the guide part 90 is positioned on a side closer to the second binding teeth 72 than a rear-side portion 8X, which is positioned on the most rear side, of the load-applied place 8A.

In this way, when comparing the portions positioned on the most rear sides, if the rear-side portion 90B of the guide part 90 is positioned on a side closer to the second binding teeth 72 than the rear-side portion 8X of the load-applied place 8A, it may be said that the guide part 90 is positioned on a side closer to the second binding teeth 72 than the load-applied place 8A.

The guide part 90 is configured to guide the second binding teeth 72 by guiding a part, which is positioned on a side closer to the second binding teeth 72 than the load-applied place 8A, of the interlocking part 600 configured to interlock with the second binding teeth 72.

More specifically, the guide part 90 is configured to guide the second binding teeth 72 by guiding the rod-shaped member 640 positioned on a side closer to the second binding teeth 72 than the load-applied place 8A.

Also, in the exemplary embodiment, assuming a virtual plane H1 passing the load-applied place 8A and the second binding teeth 72 and extending along the linear path 4Y (refer to FIG. 5), the guide parts 90 are each provided in each of two regions R1 and R2 facing each other with the plane H1 being interposed therebetween.

More specifically, in the exemplary embodiment, assuming the virtual plane H1 passing a central part C1 of the load-applied place 8A and a central part C2 in the length direction of the second binding teeth 72 and extending along the linear path 4Y, the guide parts 90 are each provided in each of two regions R1 and R2 facing each other with the plane H1 being interposed therebetween.

In other words, in the exemplary embodiment, assuming the virtual plane H1 passing an axis center 510R of the screw member 510 and the central part C2 in the length direction of the second binding teeth 72 and extending along the linear path 4Y, the guide parts 90 are each provided in each of two regions R1 and R2 facing each other with the plane H1 being interposed therebetween.

Also, in the exemplary embodiment, each of the guide parts 90 provided in each of the two regions R1 and R2 is arranged on a side closer to the second binding teeth 72 than the load-applied place 8A.

In the exemplary embodiment, when the second binding teeth 72 are pressed against the sheet bundle T, the second binding teeth 72 are pressed upward by a reaction, so that one end portion 631-side of the upper support member 630 is moved upward.

In this case, like the exemplary embodiment, when each of the guide parts 90 is positioned on a side closer to the second binding teeth 72 than the load-applied place 8A, one end portion 631 of the upper support member 630 is difficult to move upward.

Further, in the exemplary embodiment, assuming a virtual line LX passing through an axis center 610R of the female thread part 610 and extending along the length direction of the second binding teeth 72, the guide parts 90 are positioned at places deviating from the virtual line LX.

More specifically, the guide parts 90 are positioned on a side closer to the second binding teeth 72 than the virtual line LX.

FIG. 8 shows a sectional view of the second binding processing device 52, as seen from above. In a state where the second binding processing device 52 is seen from above, the guide parts 90 are positioned on a side closer to the second binding teeth 72 than the virtual line LX.

The description "the guide parts 90 are positioned on a side closer to the second binding teeth 72 than the virtual line LX" indicates a state where, when the guide parts 90 are projected to a plane H8, a central portion 90C of each of the guide parts 90 is positioned on a side closer to the second binding teeth 72 than the virtual line LX when the virtual line LX is projected to the plane H8.

Here, the plane H8 is a plane having a relationship orthogonal to the length direction of the second binding teeth 72.

In the exemplary embodiment, when the guide part 90 and the virtual line VX are projected to the plane H8 (projected toward a direction orthogonal to the plane H8), the central portion 90C of the guide part 90 (a central portion in an extension direction of the plane H8) is positioned closer to the second binding teeth 72 than the virtual line LX.

The configuration "the guide part 90 is positioned on a side closer to the second binding teeth 72 than the virtual line LX" is not limited to the state where all portions of the guide part 90 are positioned on a side closer to the second binding teeth 72 than the virtual line LX.

As described above, when the central portion 90C of the guide part 90 is positioned closer to the second binding teeth 72 than the virtual line LX, it may be said that the guide part 90 is in a state of being positioned on a side closer to the second binding teeth 72 than the virtual line LX.

In this case, as compared to a configuration where the guide part 90 is positioned on the virtual line LX, one end portion 631 of the upper support member 630 is more difficult to move upward.

In other words, as compared to a configuration where a position of the virtual line LX coincides with a position of the central portion 90C of the guide part 90, one end portion 631 of the upper support member 630 is more difficult to move upward.

In this case, when the binding processing is performed, the second binding teeth 72 are difficult to escape upward, so that a higher load is applied to the sheet bundle T.

Also, in the exemplary embodiment, the guide parts 90 each provided in each of the two regions R1 and R2 are arranged on a common line LK extending in the length direction of the second binding teeth 72.

Additionally describing, the guide parts 90 each provided in each of the two regions R1 and R2 are arranged on the line LK extending in the length direction of the second binding teeth 72 and passing a place other than the axis center 610R of the female thread part 610.

The configuration "the guide part 90 is arranged on the line LK" indicates a state where, when the guide part 90 and the line LK are projected to the plane H8 (projected toward the direction orthogonal to the plane H8), a position of the central portion 90C of the guide part 90 (the central portion in the extension direction of the plane H8) coincides with a position of the line LK.

Further, in the exemplary embodiment, a distance L11 between the guide part 90 provided in one region R1 of the two regions R1 and R2 and the plane H1 and a distance L21 between the guide part 90 provided in the other region R2 and the plane H1 are the same. Additionally describing, in the exemplary embodiment, the distance L11 between one guide part 90 of the two guide parts 90 arranged on the common line LK and the plane H1 and the distance L21 between the other guide part 90 and the plane H1 are the same.

More specifically, a case is assumed in which the plane H1, one guide part 90 and the other guide part 90 are projected to a plane H15 extending in the length direction of the second binding teeth 72 (projected toward a direction orthogonal to the plane H15).

In this case, in the exemplary embodiment, the distance L11 between a central portion C11 of one guide part 90 (a central portion in the extension direction of the plane H15) and the plane H1 and the distance L21 between a central portion C21 of the other guide part 90 (a central portion in the extension direction of the plane H15) and the plane H1 are the same.

Further, in the exemplary embodiment, the female thread part 610, which is in contact with the screw member 510, of the interlocking part 600 is positioned closer to the right rod-shaped member 640R as an example of the second guided part than the left rod-shaped member 640L as an example of the first guided part.

Also, the female thread part 610 is positioned closer to the left rod-shaped member 640L than the right rod-shaped member 640R.

In the exemplary embodiment, the interlocking part 600 is provided with the left rod-shaped member 640L and the right rod-shaped member 640R, which are guided by the guide parts 90.

In the exemplary embodiment, the female thread part 610 as an example of the contact part is positioned closer to the right rod-shaped member 640R than the left rod-shaped member 640L and is positioned closer to the left rod-shaped member 640L than the right rod-shaped member 640R.

In the exemplary embodiment, the female thread part 610 may be regarded as the load receiving part configured to receive a load from the screw member 510. In the exemplary embodiment, the load receiving part is positioned closer to the right rod-shaped member 640R than the left rod-shaped member 640L and is positioned closer to the left rod-shaped member 640L than the right rod-shaped member 640R.

More specifically, a case is assumed in which the left rod-shaped member 640L, the right rod-shaped member 640R and the female thread part 610 are projected to a plane H15.

In this case, on the plane H15, the female thread part 610 is positioned closer to the right rod-shaped member 640R than the left rod-shaped member 640L and is positioned closer to the left rod-shaped member 640L than the right rod-shaped member 640R.

The configuration "the female thread part 610 is positioned closer to the right rod-shaped member 640R than the left rod-shaped member 640L and is positioned closer to the left rod-shaped member 640L than the right rod-shaped member 640R" is not limited to a state where the female thread part 610 is positioned in a region between the left rod-shaped member 640L and the right rod-shaped member 640R.

Figure 9:
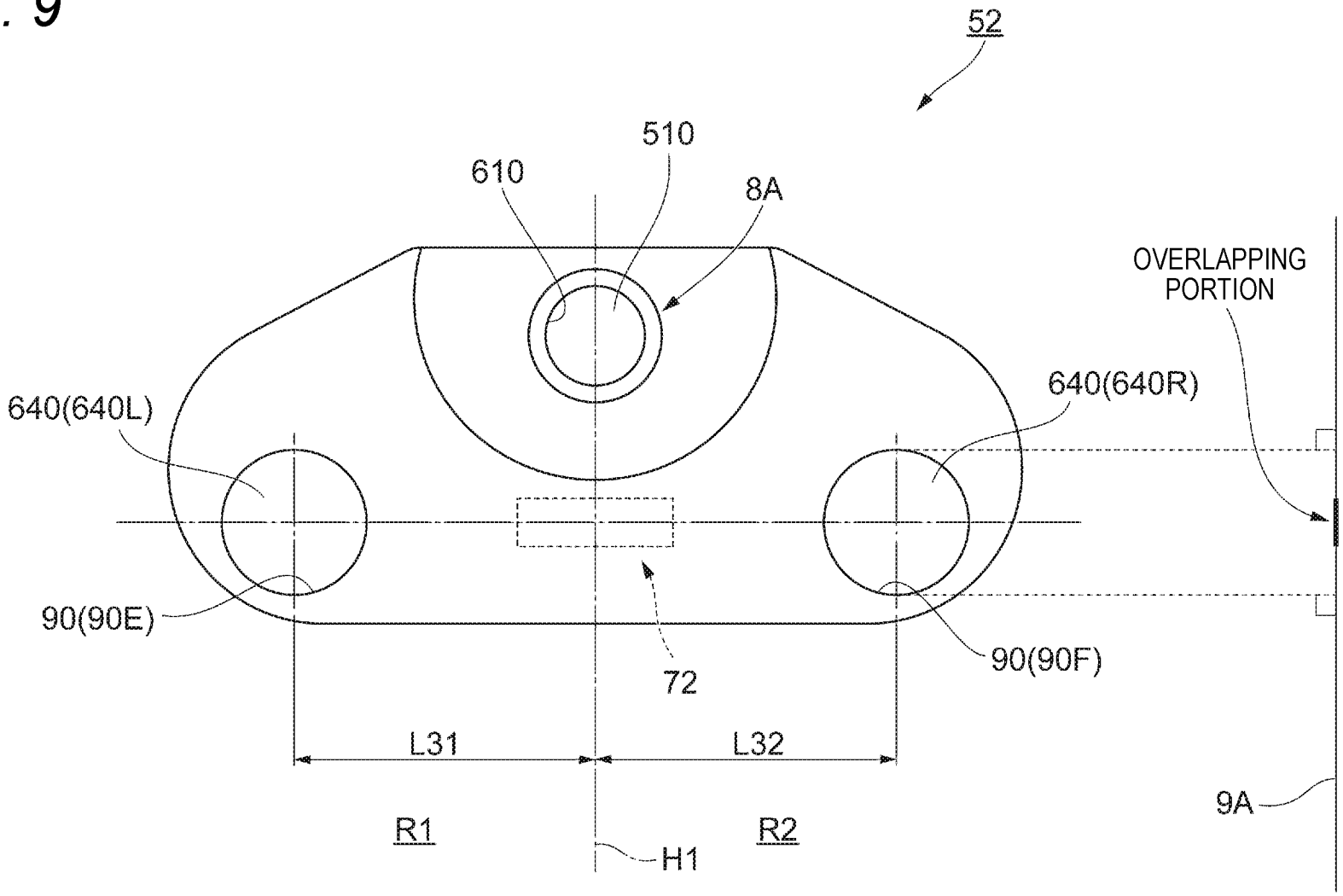
FIG. 9 shows another configuration example of the second binding processing device.

As shown in FIG. 9, which will be described later, an aspect is also considered in which the female thread part 610 is positioned at a place deviating from the region between the left rod-shaped member 640L and the right rod-shaped member 640R.

Also in the aspect shown in FIG. 9, it may be said that the female thread part 610 is positioned closer to the right rod-shaped member 640R than the left rod-shaped member 640L and is positioned closer to the left rod-shaped member 640L than the right rod-shaped member 640R.

In the exemplary embodiment, a load is applied to the load receiving member 620 of the interlocking part 600 (refer to FIG. 8), so that the second binding teeth 72 are moved toward the first binding teeth 71.

More specifically, a load is applied to the female thread part 610 of the load receiving member 620, so that the second binding teeth 72 are moved toward the first binding teeth 71.

In the exemplary embodiment, it may be said that the first binding teeth 71 and the second binding teeth 72 are positioned closer to the right rod-shaped member 640R than the left rod-shaped member 640L and are positioned closer to the left rod-shaped member 640L than the right rod-shaped member 640R.

Note that, like the above, the configuration "the first binding teeth 71 and the second binding teeth 72 are positioned closer to the right rod-shaped member 640R than the left rod-shaped member 640L and are positioned closer to the left rod-shaped member 640L than the right rod-shaped member 640R" is not limited to the state where the first binding teeth 71 and the second binding teeth 72 are positioned in the region between the left rod-shaped member 640L and the right rod-shaped member 640R.

As shown in FIG. 8, also in an aspect where the first binding teeth 71 (not shown, in FIG. 8) and the second binding teeth 72 are positioned at places deviating from the region between the left rod-shaped member 640L and the right rod-shaped member 640R, it may be said that the first binding teeth 71 and the second binding teeth 72 are positioned closer to the right rod-shaped member 640R than the left rod-shaped member 640L and are positioned closer to the left rod-shaped member 640L than the right rod-shaped member 640R.

FIG. 9 shows another configuration example of the second binding processing device 52.

In this configuration example, like the above, the guide part 90 is provided in plural.

Also, in this configuration example, the second binding teeth 72 are positioned between one guide part 90 (hereinafter, referred to as 'guide part 90E') and the other guide part 90 (hereinafter, referred to as 'guide part 90F') of the plural guide parts 90.

FIG. 9 shows the plural guide parts 90 and the second binding teeth 72, as seen from an upstream or downstream side with respect to the moving direction of the second binding teeth 72.

In FIG. 9, the second binding teeth 72 are positioned between one guide part 90E and the other guide part 90F of the plural guide parts 90.

Here, the description "positioned between" means a state where, when one guide part 90E, the other guide part 90F and the second binding teeth 72 are projected to a plane 9A having a relationship orthogonal to the length direction of the second binding teeth 72 (projected toward a direction orthogonal to the plane 9A), there is a part in which one guide part 90E, the other guide part 90F and the second binding teeth 72 are overlapped.

Also, in the configuration example shown in FIG. 9, like the above, assuming a virtual plane H1 passing the load-applied place 8A and the second binding teeth 72 and extending along the linear path 4Y, the guide parts 90 are each provided in each of two regions R1 and R2 facing each other with the plane H1 being interposed therebetween.

Further, in the configuration example, a distance L31 between one guide part 90E provided in one region R1 and the plane H1 and a distance L32 between the other guide part 90F provided in the other region R2 and the plane H1 are the same.

Further, in the configuration example, as described above, the second binding teeth 72 are positioned between one guide part 90E and the other guide part 90F.

Like this configuration example, in the configuration where the second binding teeth 72 are positioned between one guide part 90E and the other guide part 90F, a higher load may be applied to the sheet bundle T.

More specifically, in this configuration example, as compared to a configuration where the second binding teeth 72 are positioned at a place deviating from a region between one guide part 90E and the other guide part 90F, the second binding teeth 72 are more difficult to escape upward, so that the higher load may be applied to the sheet bundle T.

Here, when performing the binding processing in the binding position shown in FIGS. 3A and 3B, the configuration may be like the configuration shown in FIG. 8 where the rod-shaped members 640 and the guide parts 90 are not provided on both sides of the second binding teeth 72.

More specifically, in order to avoid interference between the rod-shaped members 640 and the sheet bundle T, the rod-shaped members 640 and the guide parts 90 may not be provided on both sides of the second binding teeth 72 in the configuration.

In contrast, for example, in the second binding processing device 52 configured to perform binding on only a corner portion of the sheet bundle T, as shown in FIG. 9, the binding may be performed on the sheet bundle T even with the configuration where the second binding teeth 72 are positioned between one guide part 90E and the other guide part 90F, as shown in FIG. 9.

Note that, in addition, the guide parts 90 may also be provided on an opposite side to a side on which the second binding teeth 72 are positioned, with the load-applied place 8A (refer to FIG. 9) being interposed therebetween.

In the exemplary embodiment, as described above, the second binding teeth 72 are applied with the reaction from the sheet bundle T, so that one end portion 631 of the upper support member 630 is moved upward. In this case, the other end portion 634 (refer to FIG. 8) of the upper support member 630 is moved downward.

When the guide parts 90 are provided on an opposite side to a side on which the second binding teeth 72 are positioned, with the load-applied place 8A being interposed, the other end portion 634 of the upper support member 630 is restrained from moving downward. Thereby, also in this case, one end portion 631 of the upper support member 630 is restrained from moving upward.

Also in this case, the second binding teeth 72 are difficult to escape upward, so that higher load may be applied to the sheet bundle T.

Figure 10:
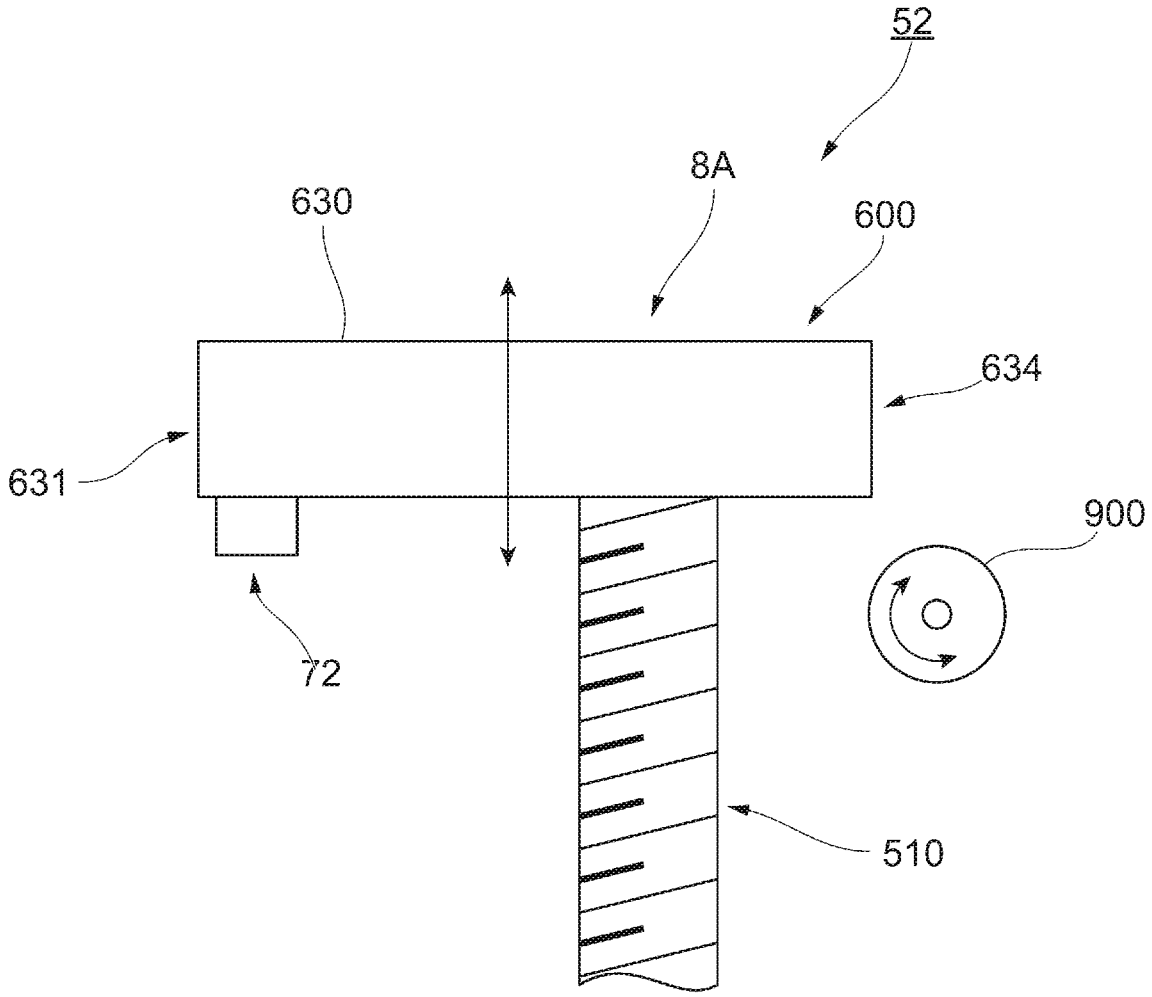
FIG. 10 shows another configuration example of the second binding processing device, showing an interlocking part and the like, as seen from a direction denoted with an arrow X in FIG. 5.

FIG. 10 shows another configuration example of the second binding processing device 52, showing the interlocking part 600 and the like, as seen from a direction denoted with an arrow X in FIG. 5. In FIG. 10, the interlocking part 600, the screw member 510 and the like are shown, and the other members are not shown.

In the configuration example shown in FIG. 10, a restraint part 900 configured to restrain the interlocking part 600 from moving is provided.

The restraint part 900 is configured to restrain a part of the interlocking part 600, which is positioned on an opposite side to a side on which the second binding teeth 72 are positioned with the load-applied place 8A being interposed, from moving.

More specifically, the restraint part 900 is configured to contact the other end portion 634 of the upper support member 630, which is positioned on an opposite side to one end portion 631 that is an end portion on a side on which the second binding teeth 72 are provided, and to restrain the other end portion 634 from moving downward.

Here, in the exemplary embodiment, as described above, the second binding teeth 72 are applied with the reaction from the sheet bundle T, so that the other end portion 634 of the upper support member 630 is accordingly moved downward. The restraint part 900 is configured to restrain the other end portion 634 from moving downward.

Thereby, also in this case, the second binding teeth 72 are difficult to escape upward, so that higher load may be applied to the sheet bundle T.

Here, the restraint part 900 of the exemplary embodiment is constituted by a rotary body, and is configured to restrain the other end portion 634 from moving downward while permitting the other end portion 634 to move downward.

Note that, the restraint part 900 is not limited to the above. For example, an inclination surface formed to extend in the upper and lower direction and closer to the other end portion 634 as it is further directed downward may be provided, and the other end portion 634 may be restrained from moving by the inclination surface.

Figure 11:
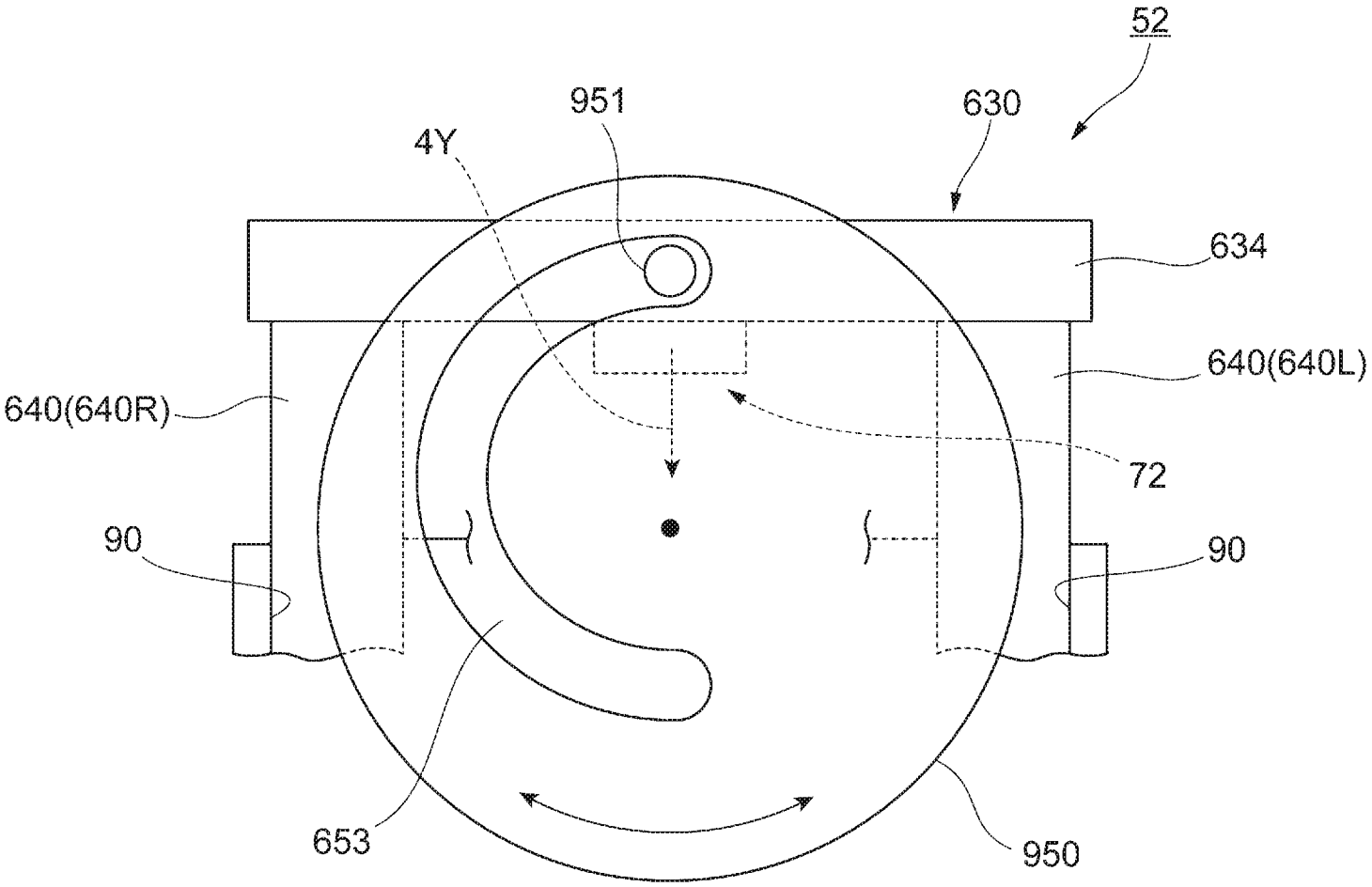
FIG. 11 shows another configuration example of the second binding processing device.

FIG. 11 shows another configuration example of the second binding processing device 52.

Here, FIG. 11 shows a part of the second binding processing device 52, when seeing the second binding processing device 52 in a direction denoted with an arrow XI in FIG. 4. Additionally describing, FIG. 11 shows a part of the second binding processing device 52, as seen from a rear side of the second binding processing device 52.

In the configuration example shown in FIG. 11, a rotation member 950 configured to rotate by a drive source such as a motor is provided at the rear of the second binding processing device 52.

In this configuration example, the other end portion 634 of the upper support member 630 is provided with a protrusion 951 protruding toward the rotation member 950.

The rotation member 950 is provided with a groove 653, which the protrusion 951 provided to the upper support member 950 is accommodated therein and is configured to guide the protrusion 951. In this configuration example, the protrusion 951 is guided by an inner surface of the groove 653, so that the upper support member 950 moves up and down and the second binding teeth 72 accordingly move up and down.

Also in this configuration example, like the above, the rod-shaped members 940 are provided, the guide parts 90 configured to guide the rod-shaped members 640 are provided, and the second binding teeth 72 are configured to move up and down along the linear path 4Y.

Figure 12:
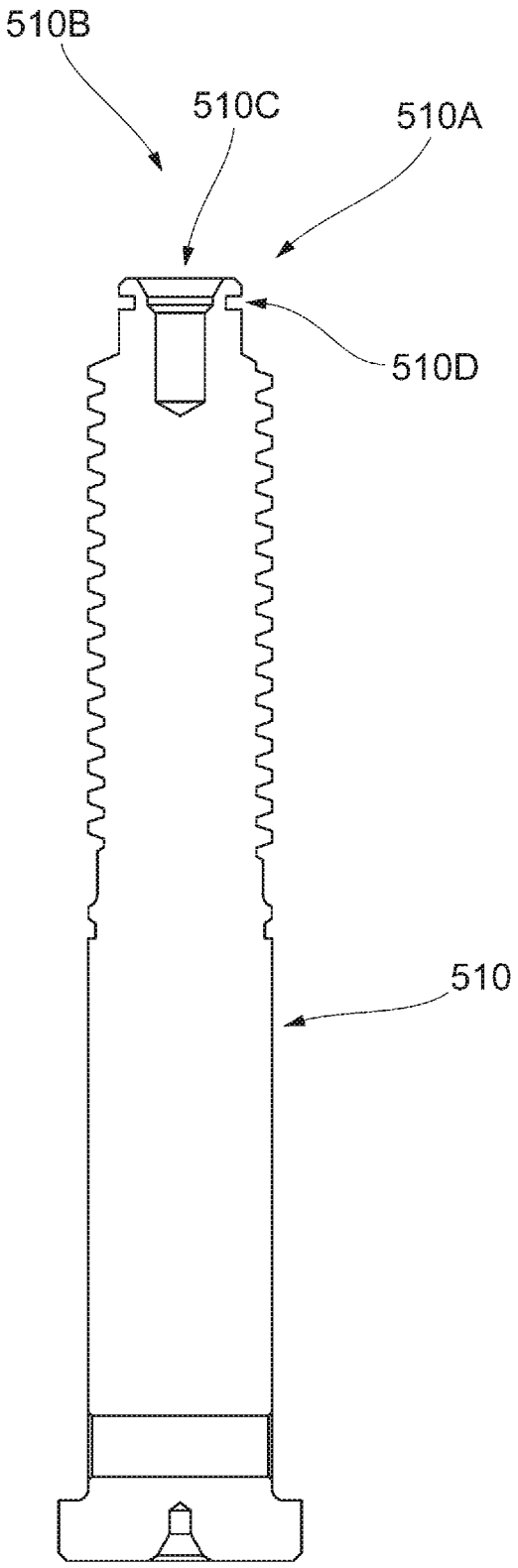
FIG. 12 is a longitudinal sectional view of a screw member.

FIG. 12 is a longitudinal sectional view of the screw member 510.

In the exemplary embodiment, a restraint member configured to restrain movement of the interlocking part 600 (refer to FIG. 4) may be attached to the screw member 510.

Specifically, one end portion 510A of the screw member 510 is provided with a to-be-attached part 510B. The restraint member may be attached to the to-be-attached part 510B.

Specifically, an end face located at one end portion 510A of the screw member 510 is provided with a concave portion 510C that is concave toward an inside of the screw member 510 and has a circular section. An inner surface of the concave portion 510C is formed with a female thread. In the exemplary embodiment, a restraint member 980 (refer to FIG. 4) having a male thread is attached to the female thread part.

In the exemplary embodiment, when the screw member 510 rotates beyond necessity and the interlocking part 600 reaches one end portion 510A (refer to FIG. 12) of the screw member 510, the interlocking part 600 collides with the restraint member 980, so that movement of the interlocking part 600 is restrained.

Thereby, the interlocking part 600 is suppressed from separating from the screw member 510.

Also, in the exemplary embodiment, a groove 510D extending along a circumferential direction of the screw member 510 is formed on an outer peripheral surface of one end portion 510A of the screw member 510.

In the exemplary embodiment, for example, a stopper (not shown) having an E-shaped or C-shaped section may be mounted to the groove 510D. In the exemplary embodiment, movement of the interlocking part 600 may also be restrained by the stopper.

Figure 13:
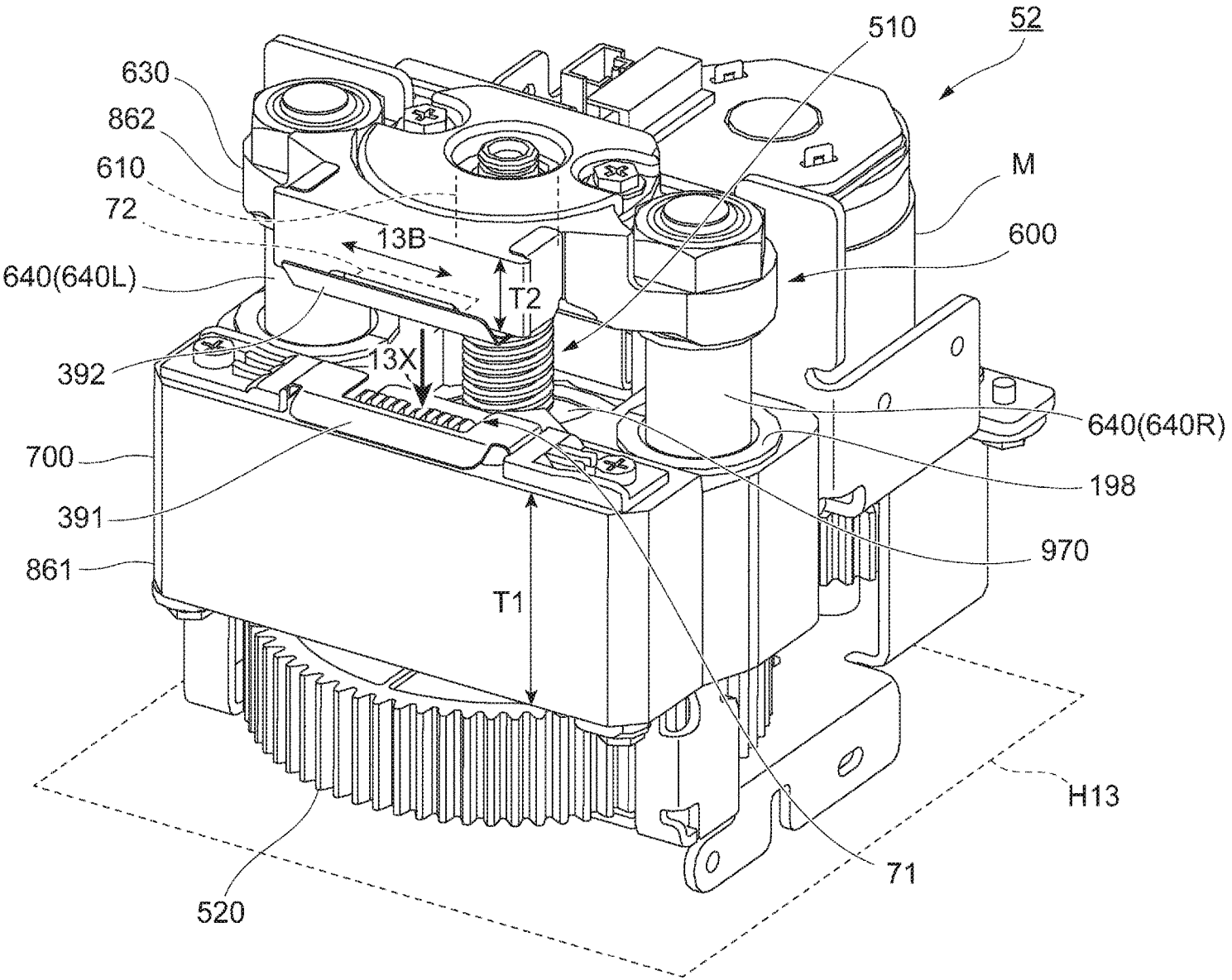
FIG. 13 is a perspective view showing another configuration example of the second binding processing device.

FIG. 13 is a perspective view showing another configuration example of the second binding processing device 52.

Note that, the constitutional elements of the second binding processing device 52 shown in FIG. 13 are the same as the constitutional elements of the second binding processing device 52 as described above.

In the configuration example shown in FIG. 12, the positional relationship among the left rod-shaped member 640L, the right rod-shaped member 640R, the screw member 510 and the female thread part 610 is different from the above-described positional relationship.

Specifically, in the configuration example of FIG. 13, the screw member 510 and the female thread part 610 as an example of the load receiving part are provided between the left rod-shaped member 640L, which is a first guided part, and the right rod-shaped member 640R, which is a second guided part.

More specifically, in this configuration example, when the left rod-shaped member 640L, the right rod-shaped member 640R, the screw member 510 and the female thread part 610 are projected toward an upstream or downstream side with respect to the moving direction of the second binding teeth 72, the screw member 510 and the female thread part 610 are positioned between the left rod-shaped member 640L and the right rod-shaped member 640R.

More specifically, a case is assumed in which the left rod-shaped member 640L, the right rod-shaped member 640R, the screw member 510 and the female thread part 610 are projected toward an upstream or downstream side with respect to the moving direction of the second binding teeth 72 and toward a virtual plane H13 having a relationship orthogonal to the moving direction of the second binding teeth 72.

In this case, on the virtual plane H13, the screw member 510 and the female thread part 610 are positioned between the left rod-shaped member 640L and the right rod-shaped member 640R.

Here, the configuration "the screw member 510 and the female thread part 610 are positioned between the left rod-shaped member 640L and the right rod-shaped member 640R" is not limited to a state where all portions of the female thread part 610 and all portions of the screw member 510 are positioned between the left rod-shaped member 640L and the right rod-shaped member 640R, and includes a state where a portion of the female thread part 610 and a portion of the screw member 510 are positioned between the left rod-shaped member 640L and the right rod-shaped member 640R.

Note that, in the exemplary embodiment, all portions of the female thread part 610 and all portions of the screw member 510 are positioned between the left rod-shaped member 640L and the right rod-shaped member 640R.

Also, in this configuration example, when the left rod-shaped member 640L, the right rod-shaped member 640R, the first binding teeth 71 and the second binding teeth 72 are projected toward the upstream or downstream side with respect to the moving direction of the second binding teeth 72, the first binding teeth 71 and the second binding teeth 72 are positioned at places deviating from a region between the left rod-shaped member 640L and the right rod-shaped member 640R.

In the exemplary embodiment, as the guided part, the two guided parts of the left rod-shaped member 640L and the right rod-shaped member 640R are provided. However, in this configuration example, the first binding teeth 71 and the second binding teeth 72 are positioned at places deviating from a region between the two guided parts.

More specifically, a case is assumed in which the left rod-shaped member 640L, the right rod-shaped member 640R, the first binding teeth 71 and the second binding teeth 72 are projected toward the upstream or downstream side with respect to the moving direction of the second binding teeth 72 and toward the virtual plane H13 having a relationship orthogonal to the moving direction of the second binding teeth 72.

In this case, on the virtual plane H13, the first binding teeth 71 and the second binding teeth 72 are positioned at places deviating from a region between the left rod-shaped member 640L and the right rod-shaped member 640R.

Also, a case is assumed in which the left rod-shaped member 640L, the right rod-shaped member 640R, the first binding teeth 71 and the second binding teeth 72 are projected toward the upstream or downstream side with respect to the moving direction of the second binding teeth 72.

In this case, the first binding teeth 71 and the second binding teeth 72 are positioned closer to the right rod-shaped member 640R than the left rod-shaped member 640L and are positioned closer to the left rod-shaped member 640L than the right rod-shaped member 640R.

In other words, on the virtual plane H13, the first binding teeth 71 and the second binding teeth 72 are positioned closer to the right rod-shaped member 640R than the left rod-shaped member 640L and are positioned closer to the left rod-shaped member 640L than the right rod-shaped member 640R.

Also, a case is assumed in which the left rod-shaped member 640L, the right rod-shaped member 640R, the first binding teeth 71, the second binding teeth 72 and the female thread part 610 are projected toward the upstream or downstream side with respect to the moving direction of the second binding teeth 72.

In this case, in the exemplary embodiment, the female thread part 610 is positioned closer to a side on which the left rod-shaped member 640L and the right rod-shaped member 640R are provided than the first binding teeth 71 and the second binding teeth 72.

In other words, on the virtual plane H13, the female thread part 610 is positioned closer to a side on which the left rod-shaped member 640L and the right rod-shaped member 640R are provided than the first binding teeth 71 and the second binding teeth 72.

Also, a case is assumed in which the left rod-shaped member 640L, the right rod-shaped member 640R, the screw member 510 and the female thread part 610 are projected toward the upstream or downstream side with respect to the moving direction of the second binding teeth 72.

In this case, in the exemplary embodiment, the screw member 510 and the female thread part 610 as an example of the load receiving part are positioned between the left rod-shaped member 640L and the right rod-shaped member 640R.

In other words, on the virtual plane H13, the screw member 510 and the female thread part 610 are positioned between the left rod-shaped member 640L and the right rod-shaped member 640R.

In other words, on the virtual plane H13, the screw member 510 and the female thread part 610 are positioned in a region between the left rod-shaped member 640L and the right rod-shaped member 640R.

Also, in the configuration example shown in FIG. 13, a first elastic member 391 for separating the sheet bundle T subjected to the binding processing from the first binding teeth 71 is attached to the lower support member 700.

Further, in the exemplary embodiment, a second elastic member 392 for separating the sheet bundle T subjected to the binding processing from the second binding teeth 72 is attached to the upper support member 630.

In the exemplary embodiment, when performing the binding processing on the sheet bundle T, the first elastic member 391 and the second elastic member 392 are sandwiched and pressed by the upper support member 630 and the lower support member 700.

Also, in the exemplary embodiment, when the binding processing on the sheet bundle T is over and the second binding teeth 72 retreat from the first binding teeth 71, the first elastic member 391 and the second elastic member 392 in a compressed state are restored.

Thereby, the sheet bundle T is pressed by the first elastic member 391 and the second elastic member 392, and the sheet bundle T separates from the first binding teeth 71 and the second binding teeth 72.

Note that, although not described in the above, the first elastic member 391 and the second elastic member 392 are also provided to the second binding processing device 52 shown in FIGS. 4 to 11, in a similar manner.

Figure 14A:
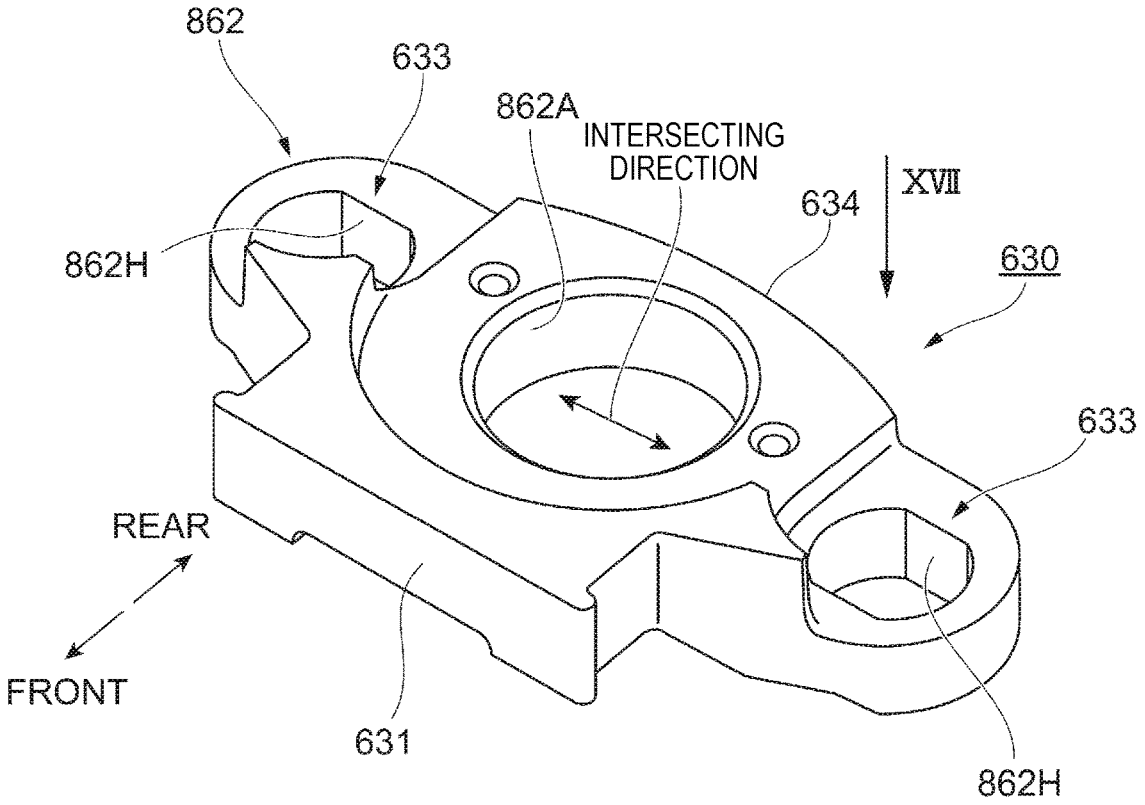
FIG. 14A is a perspective view of an upper support member provided to the second binding processing device.
Figure 14B:
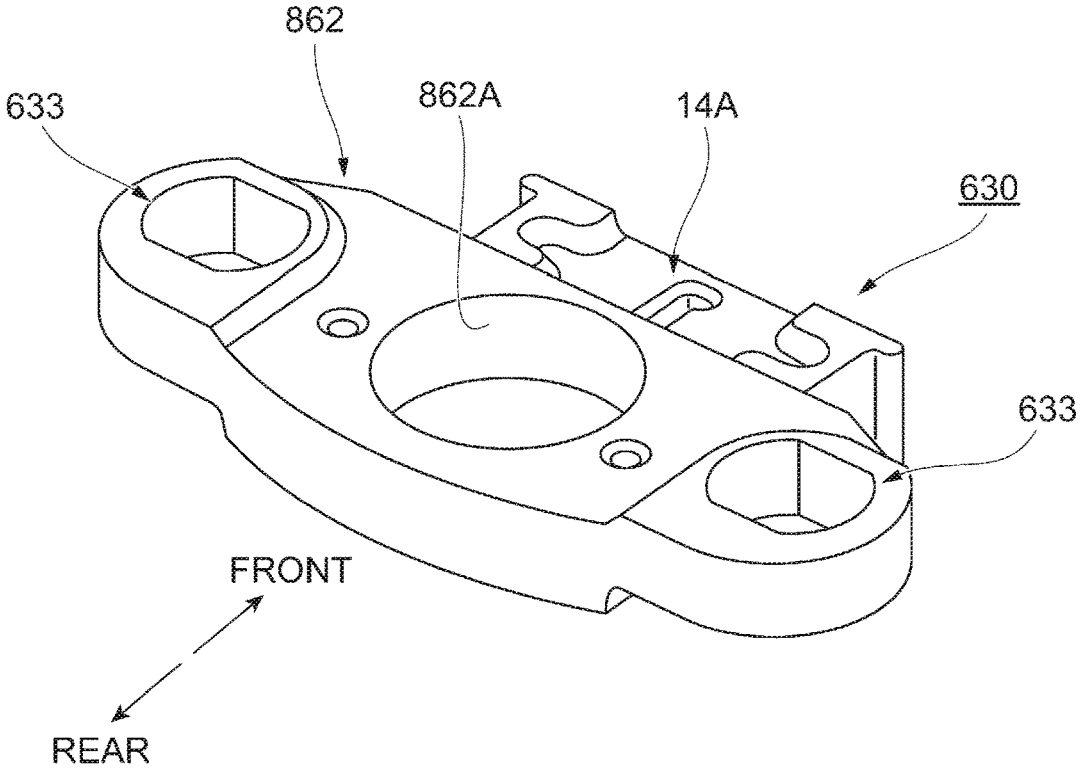
FIG. 14B is a perspective view of an upper support member provided to the second binding processing device.

FIG. 14A is a perspective view showing the upper support member 630 provided to the second binding processing device 52, as seen from above, and FIG. 14B is a perspective view showing the upper support member 530, as seen from below.

As described above, the upper support member 630 is configured to support the second binding teeth 72 (not shown, in FIGS. 14A and 14B), which are an example of the second teeth. In the exemplary embodiment, the second binding teeth 72 are fixed to a place (which is shown with a reference sign 14A in FIG. 14B) of the upper support member 630 by press-fitting.

The upper support member 630 is constituted by a metallic block (hereinafter, referred to as 'second metal block 862'). Note that, the upper support member 630 in the embodiments shown in FIGS. 4 to 11 is also constituted by a metallic block.

The second metal block 862 is constituted by a metallic sintered body, and has high hardness.

The second metal block 862 may also be made by casting or forging. When the second metal block 862 is constituted by a metallic sintered body or made by casting or forging, the hardness of the second metal block 862 increases.

The interlocking part 600 (refer to FIG. 13) is constituted by a combination of plural members. In the exemplary embodiment, a member, to which the second binding teeth 72 are attached, of the interlocking part 600 is constituted by the second metal block 862.

Further, in the exemplary embodiment, as shown in FIGS. 14A and 14B, the second metal block 862 is formed with a hole 862A for a moving member. In the exemplary embodiment, the screw member 510 as an example of the moving member passes through the hole 862A for a moving member.

In other words, in the exemplary embodiment, the screw member 510 as an example of the moving member that is used so as to move the second metal block 862 toward a first metal block 861 (which will be described later) passes through the hole 862A for a moving member.

Also, as shown in FIGS. 14A and 14B, the second metal block 862 is formed with two through-holes 633.

Here, the through-hole 633 is an example of the guiding hole. In the exemplary embodiment, the rod-shaped member 640 as an example of the guiding member that is used so as to guide the second metal block 862 moving toward the first metal block 861 is inserted in the through-hole 633.

In this configuration example, the hole 862A for a moving member is provided between the two through-holes 633.

Figure 15:
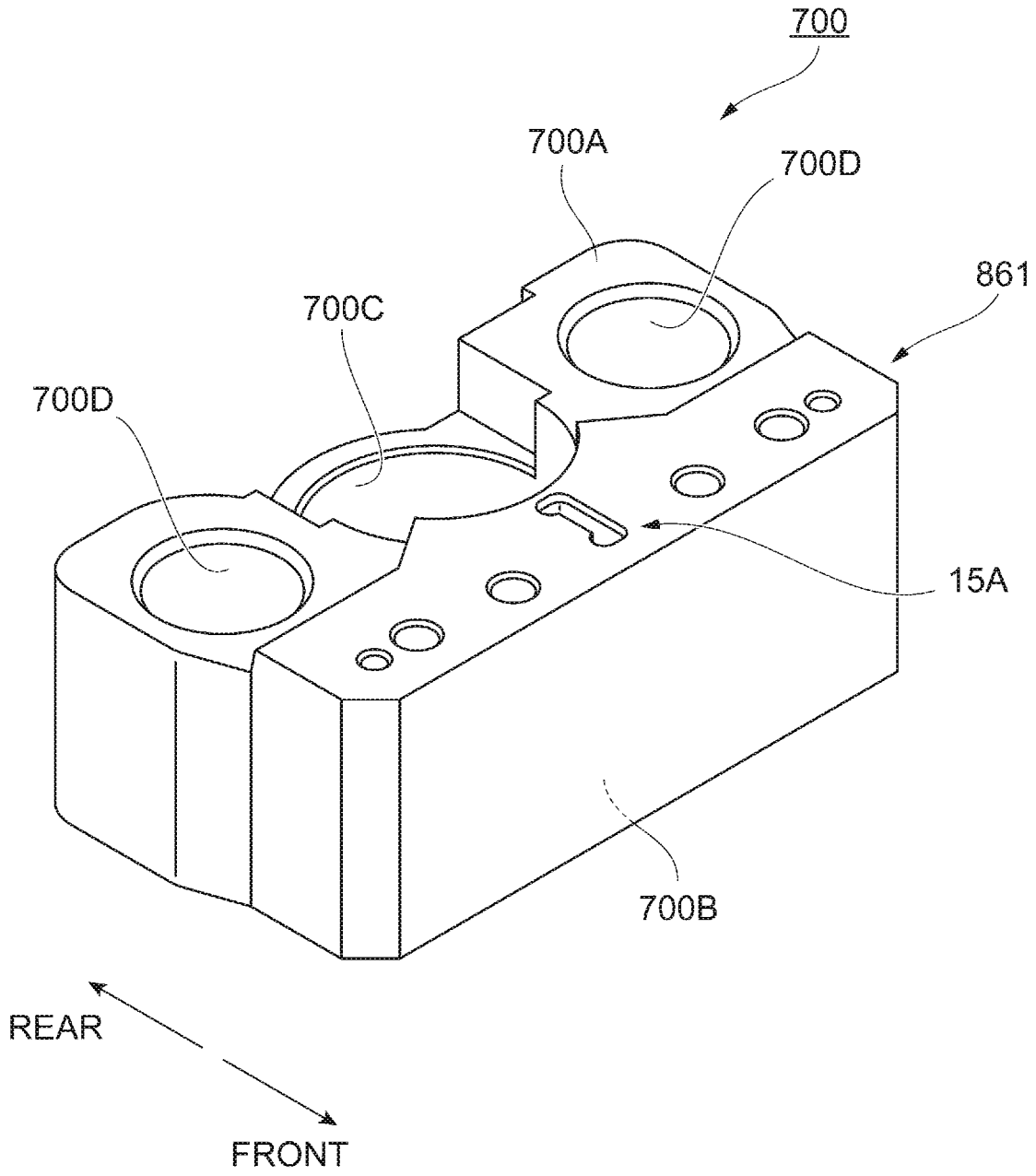
FIG. 15 is a perspective view of a lower support member.

FIG. 15 is a perspective view of the lower support member 700.

As described above, the lower support member 700 is configured to support the first binding teeth 71 (not shown in FIG. 15), which are an example of the first teeth. Specifically, in the exemplary embodiment, the first binding teeth 71 is fixed to a place denoted with a reference sign 15A by press-fitting.

The lower support member 700 is also constituted by a metallic block (hereinafter, referred to as 'first metal block 861'). Note that, the lower support member 700 in the embodiments shown in FIGS. 4 to 11 is also constituted by a metallic block.

The first metal block 861 is constituted by a metallic sintered body, and has high hardness.

The first metal block 861 may also be made by casting or forging. When the first metal block 861 is constituted by a metallic sintered body or made by casting or forging, the hardness of the first metal block 861 increases.

As used herein, 'metal block' indicates a metallic block formed by any one method of casting, forging and sintering, not a plate or a bent plate.

The lower support member 700 as an example of the support member has one surface 700A and the other surface 700B. In other words, the first metal block 861 has one surface 700A and the other surface 700B.

The first binding teeth 71 are attached to the one surface 700A of the lower support member 700.

The lower support member 700 is also provided with a through-hole 700C penetrating from the other surface 700B toward one surface 700A. The screw member 510 (refer to FIG. 13) passes through the through-hole 700C.

Note that, in the exemplary embodiment, as shown in FIG. 13, a cylindrical bearing 970 is arranged in the through-hole 700C. In the exemplary embodiment, a part of the screw member 510 positioned in the through-hole 700C is supported by the bearing 970.

The through-hole 700C (refer to FIG. 15) may be regarded as a hole for a moving member, and the lower support member 700 is also provided with a hole for a moving member through which the screw member 510 as an example of the moving member passes.

The lower support member 700 is also provided with two guiding holes 700D in which the rod-shaped members 640, which are guiding members used to guide the second metal block 862 moving toward the first metal block 861, are inserted.

In the exemplary embodiment, the hole portions 91 shown in FIG. 5 are implemented by the guiding holes 700D.

In the exemplary embodiment, the through-hole 700C as an example of the hole for a moving member is provided between the two guiding holes 700D.

The interlocking part 600 shown in FIG. 13 is provided on one surface 700A-side of the lower support member 700 shown in FIG. 15.

In the exemplary embodiment, when the screw member 510 (FIG. 13) rotates in the circumferential direction, the interlocking part 600 comes close to one surface 700A (refer to FIG. 15) of the lower support member 700.

Thereby, the second binding teeth 72 attached to the interlocking part 600 come close to the first binding teeth 71 attached on the one surface 700A-side.

Also in the configuration example shown in FIG. 13, like the above, the large-diameter gear 520 connected to the screw member 510 and configured to receive a drive force that is transmitted to the screw member 510 is provided.

The large-diameter gear 520 is provided on an opposite side to a side on which the interlocking part 600 is provided, with the lower support member 700 being interposed therebetween.

Figure 16:
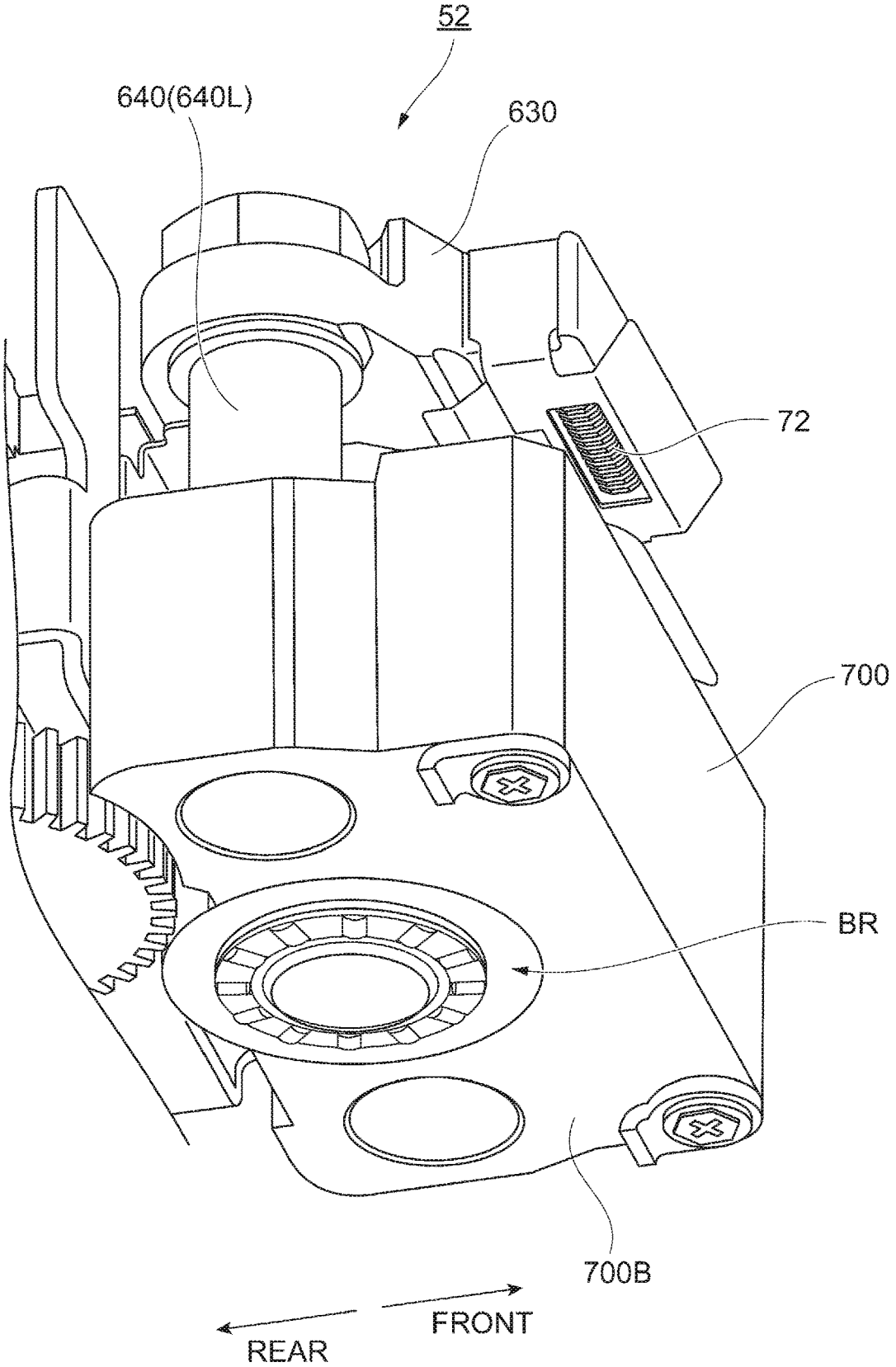
FIG. 16 is a perspective view of the second binding processing device, as seen from below, showing a state of the second binding processing device where a large-diameter gear is removed.

FIG. 16 is a perspective view of the second binding processing device 52, as seen from below, showing a state of the second binding processing device 52 where the large-diameter gear 520 is removed.

In the exemplary embodiment, a bearing BR is provided between the lower support member 700 and the large-diameter gear 520 (refer to FIG. 13).

More specifically, in the exemplary embodiment, as the bearing BR, a thrust bearing where cylindrical rotary bodies are radially arranged is provided.

In the exemplary embodiment, when the second binding teeth 72 are pressed against the sheet bundle T, the large-diameter gear 520 is pressed against the other surface 700B of the lower support member 700, so that the large-diameter gear 520 is difficult to rotate.

In contrast, when the bearing BR is provided, like the exemplary embodiment, the large-diameter gear 520 may easily rotate, as compared to a configuration where the bearing BR is not provided.

In the exemplary embodiment, the hardness of the second metal block 862 (refer to FIGS. 14A and 14B) that constitutes the upper support member 630 is different from the hardness of the first metal block 861 (refer to FIG. 15) that constitutes the lower support member 700.

In the exemplary embodiment, the hardness of the second metal block 862 is higher than the hardness of the first metal block 861.

In other words, in the exemplary embodiment, the hardness of the second metal block 862, which is a member to which the second binding teeth 72 are attached, of the interlocking part 600 is higher than the hardness of the first metal block 861, which is a member to which the first binding teeth 71 are attached.

More specifically, in the exemplary embodiment, the second metal block 862 is quenched but the first metal block 861 is not quenched, so that the hardness of the second metal block 862 is higher than the hardness of the first metal block 861.

In the exemplary embodiment, the first metal block 861 and the second metal block 862 are formed of SUS series metal. Note that, the present invention is not limited thereto. For example, the first metal block 861 and the second metal block 862 may also be formed of metals other than SUS series metal.

Further, in the exemplary embodiment, the hardness of the first binding teeth 71 and the second binding teeth 72 is the greatest. The hardness of the second metal block 862 is next great, and the hardness of the first metal block 861 is next great.

Further, in the exemplary embodiment, a volume of the first metal block 861 is different from a volume of the second metal block 862.

Specifically, in the exemplary embodiment, the volume of the second metal block 862 is smaller than the volume of the first metal block 861.

In other words, in the exemplary embodiment, the volume of the first metal block 861, which is a member to which the first binding teeth 71 are attached, is larger than the volume of the second metal block 862, which is a member to which the second binding teeth 72 are attached, of the interlocking part 600.

In the exemplary embodiment, while the second binding teeth 72 move toward the first binding teeth 71, the first binding teeth 71 are in a stationary state without moving.

In the exemplary embodiment, the first binding teeth 71 in a stationary state and the first metal block 861 configured to support the first binding teeth 71 are configured to receive the load from the second binding teeth 72.

In the exemplary embodiment, the volume of the first metal block 861, which is a metal block that receives the load, is larger than the volume of the second metal block 862 configured to move.

Further, in the exemplary embodiment, when comparing a thickness in the axis direction of the screw member 510, as shown in FIG. 13, a thickness T1 of the first metal block 861 is greater than a thickness T2 of the second metal block 862.

In the exemplary embodiment, as described above, the first binding teeth 71 is arranged in a stationary state without moving, and the first binding teeth 71 and the first metal block 861 are configured to receive the load from the second binding teeth 72.

In the exemplary embodiment, the thickness T1 of the first metal block 861, which is a metal block that receives the load, is larger than the thickness T2 of the second metal block 862 configured to move.

In the exemplary embodiment, the rod-shaped members 640 that are guided by the first metal block 861 are attached to the second metal block 862 shown in FIGS. 14A and 14B.

Specifically, in the exemplary embodiment, the rod-shaped member 640 as an example of the guided member is fixed to the second metal block 862 in a state of being inserted in the through-hole 633 that is an example of the hole provided in the second metal block 862.

Further, in the exemplary embodiment, the rod-shaped member 640 is guided by an inner surface of the guiding hole 700D that is an example of the hole provided in the first metal block 861 (refer to FIG. 15).

Also, in the exemplary embodiment, as movement of the second metal block 862 relative to the rod-shaped member 640 (refer to FIG. 13), the second metal block 862 may be moved in a direction of intersecting with the moving direction of the second binding teeth 72.

Specifically, in the exemplary embodiment, a direction denoted with an arrow 13X in FIG. 13 is the moving direction of the second binding teeth 72, and the second metal block 862 may be moved in a direction denoted with an arrow 13B, which is a direction of intersecting with the moving direction.

Specifically, as described above and as shown in FIGS. 14A and 14B, in the exemplary embodiment, the through-hole 633 as an example of the hole portion provided in the upper support member 630 is formed as a long hole.

Thereby, the second metal block 862 may be moved in the direction of intersecting with the moving direction of the second binding teeth 72.

Figure 17:
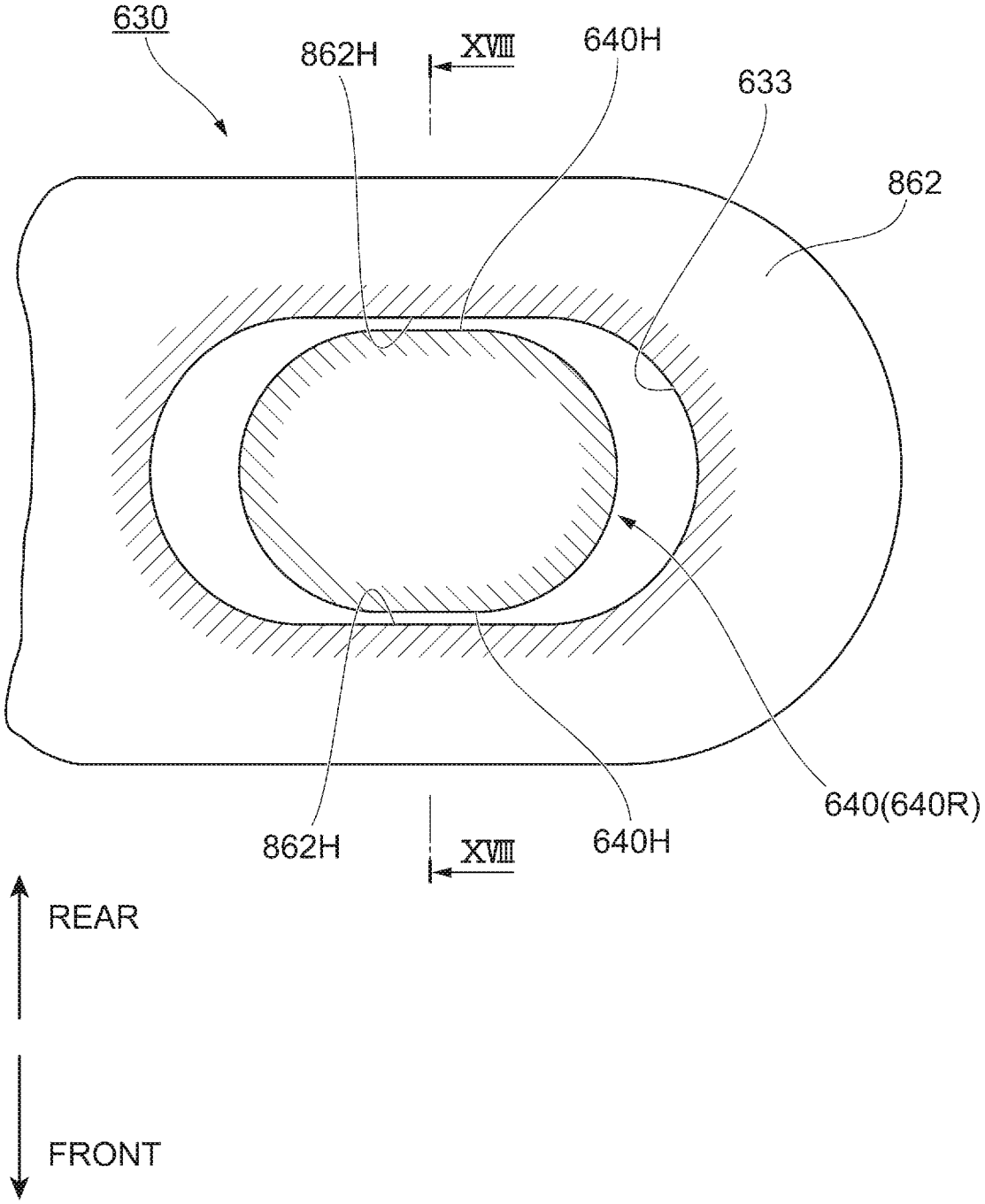
FIG. 17 shows a through-hole and a rod-shaped member inserted in the through-hole, as seen from a direction denoted with an arrow XVII in FIG. 14A.

FIG. 17 shows the through-hole 633 and the rod-shaped member 640 inserted in the through-hole 633, as seen from a direction denoted with an arrow XVII in FIG. 14A.

In the exemplary embodiment, a part, which faces the second metal block 862, of the rod-shaped member 640 is provided with a plane 640H. Specifically, a part, which faces the inner surface of the through-hole 633, of the rod-shaped member 640 is provided with the plane 640H.

Further, in the exemplary embodiment, a part, which faces the plane 640H, of the second metal block 862 is provided with a plane 862H conforming to the plane 640H.

More specifically, in the exemplary embodiment, the inner surface of the through-hole 633 formed as a long hole is provided with the plane 862H that faces the plane 640H provided to the rod-shaped member 640.

In the exemplary embodiment, the plane 640H provided to the rod-shaped member 640 and the plane 862H provided to the second metal block 862 follow a direction of intersecting with (orthogonal to) a direction facing from one end portion 631 (refer to FIG. 14A) toward the other end portion 634 of the second metal block 862.

As shown in FIG. 14A, the second metal block 862 has one end portion 631 and the other end portion 634 whose positions in an inner direction of the second binding processing device 52 are different from each other.

In the exemplary embodiment, the second binding teeth 72 (refer to FIG. 13) are attached to the one end portion 631 of the second metal block 862.

In the exemplary embodiment, the plane 640H provided to the rod-shaped member 640 and the plane 862H provided to the second metal block 862 follow the direction of intersecting with the direction facing from one end portion 631 toward the other end portion 634.

Figure 18:
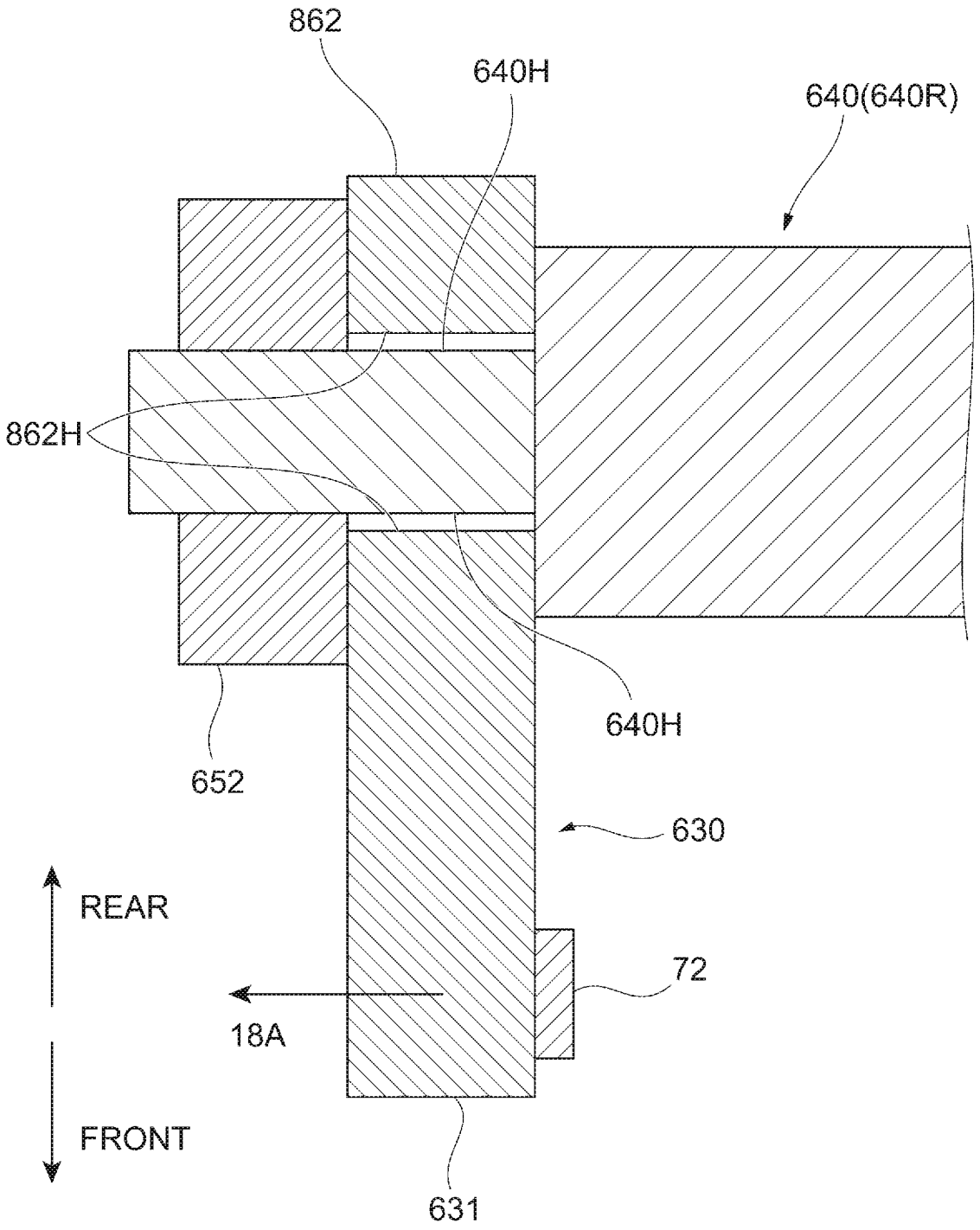
FIG. 18 is a sectional view taken along a XVIII-XVIII line in FIG. 17.

FIG. 18 is a sectional view taken along a XVIII-XVIII line in FIG. 17.

In the exemplary embodiment, when the second binding teeth 72 provided to the second metal block 862 are pressed against the sheet bundle T, the reactive force is applied to the second binding teeth 72 and one end portion 631 of the upper support member 630 is pressed toward a direction denoted with an arrow 18A.

In this case, when the plane 640H and the plane 862H extending in the intersection direction face each other, like the exemplary embodiment, the planes are contacted to each other. Thereby, the deformation of the upper support member 630 is suppressed by the rod-shaped member 640.

In this case, as compared to a configuration where the planes are not provided and the upper support member 630 is likely to be deformed, the load that is applied from the second binding teeth 72 to the sheet bundle T increases.

Figure 19:
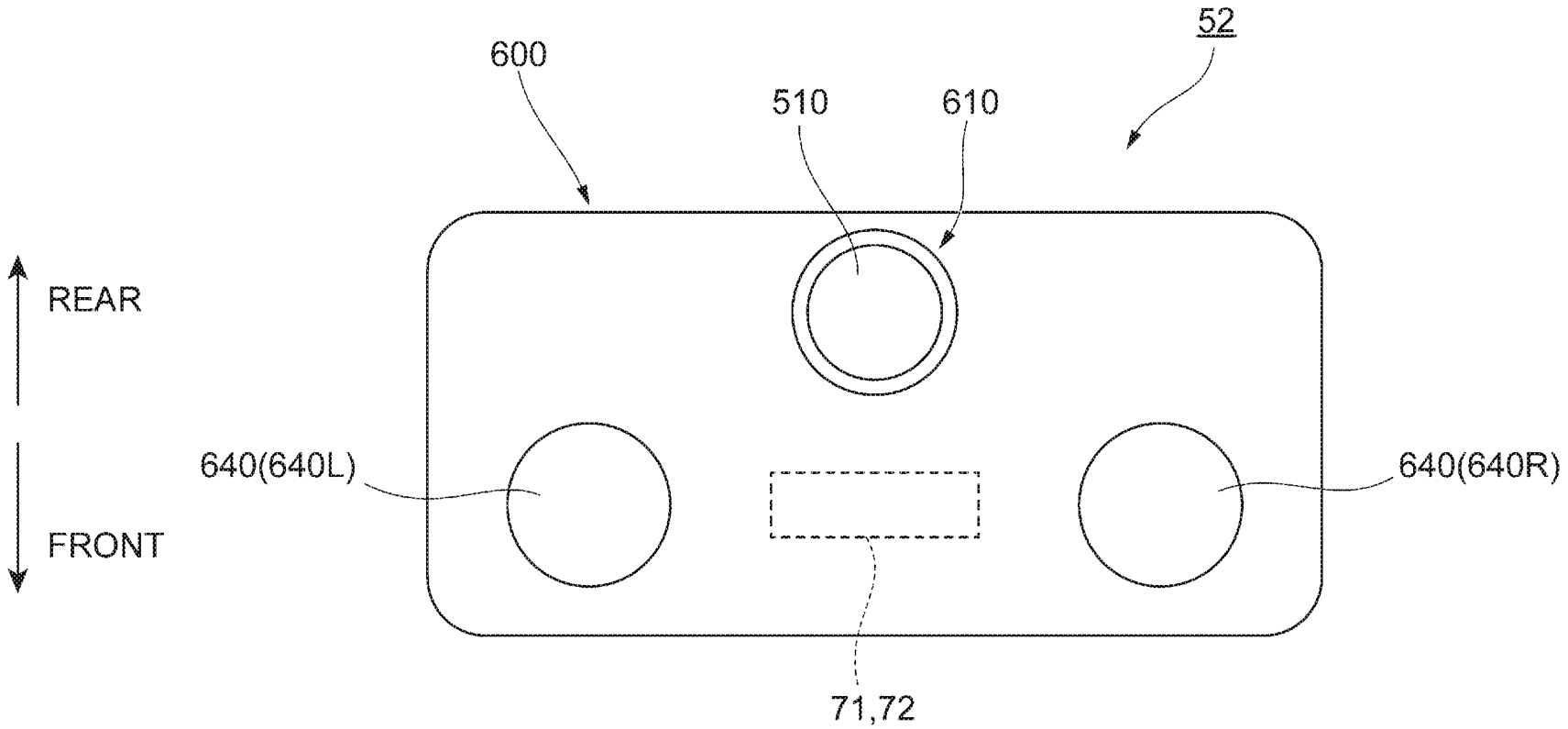
FIG. 19 shows another configuration example of the second binding processing device.

FIG. 19 shows another configuration example of the second binding processing device 52. Note that, FIG. 19 shows the second binding processing device 52, as seen from above.

In this configuration example, like the above, as the guided part provided to the interlocking part 600, the two rod-shaped members 640 of the left rod-shaped member 640L and the right rod-shaped member 640R are provided.

Also, in this configuration example, when the left rod-shaped member 640L, the right rod-shaped member 640R, the first binding teeth 71 and the second binding teeth 72 are projected toward the upstream or downstream side with respect to the moving direction of the second binding teeth 72, the first binding teeth 71 and the second binding teeth 72 are positioned between the left rod-shaped member 640L and the right rod-shaped member 640R.

More specifically, a case is assumed in which the left rod-shaped member 640L, the right rod-shaped member 640R, the first binding teeth 71 and the second binding teeth 72 are projected to the virtual plane H13 (refer to FIG. 13).

In this case, on the virtual plane H13, the first binding teeth 71 and the second binding teeth 72 are positioned between the left rod-shaped member 640L and the right rod-shaped member 640R.

Also, in the configuration example shown in FIG. 19, the screw member 510 and the female thread part 610 are positioned at places deviating from a region between the left rod-shaped member 640L and the right rod-shaped member 640R.

A case is assumed in which the screw member 510, the female thread part 610, the left rod-shaped member 640L and the right rod-shaped member 640R are projected to the virtual plane H13.

In this case, on the virtual plane H13, the screw member 510 and the female thread part 610 are positioned at places deviating from a region between the left rod-shaped member 640L and the right rod-shaped member 640R.

Like the configuration example shown in FIG. 19, the first binding teeth 71 and the second binding teeth 72 may be positioned between the left rod-shaped member 640L and the right rod-shaped member 640R.

When the first binding teeth 71 and the second binding teeth 72 are positioned between the left rod-shaped member 640L and the right rod-shaped member 640R, the binding maynot be performed in the binding positions shown in FIGS. 3A and 3B. Specifically, the sheet bundle T interferes with the left rod-shaped member 640L and the right rod-shaped member 640R, so that the binding maynot be performed.

However, even with the configuration example shown in FIG. 19, the interference may be avoided in the binding positions shown in FIGS. 3A and 3B, so that the binding may be performed on the sheet bundle T.

Further, in the exemplary embodiment, a spaced distance between the second binding teeth 72 and the screw member 510 as an example of the connection member is set equal to or smaller than a dimension of a margin of a corner portion of the sheet P constituting the sheet bundle T that is subjected to the binding processing.

Here, the screw member 510 of the exemplary embodiment is configured to function as the connection member that is connected to the interlocking part 600 and is configured to apply a load for moving the second binding teeth 72 to the interlocking part 600.

In the exemplary embodiment, the spaced distance between the second binding teeth 72 and the screw member 510 as an example of the connection member is set equal to or smaller than a dimension of a margin of a corner portion of the sheet P.

Figure 20B:
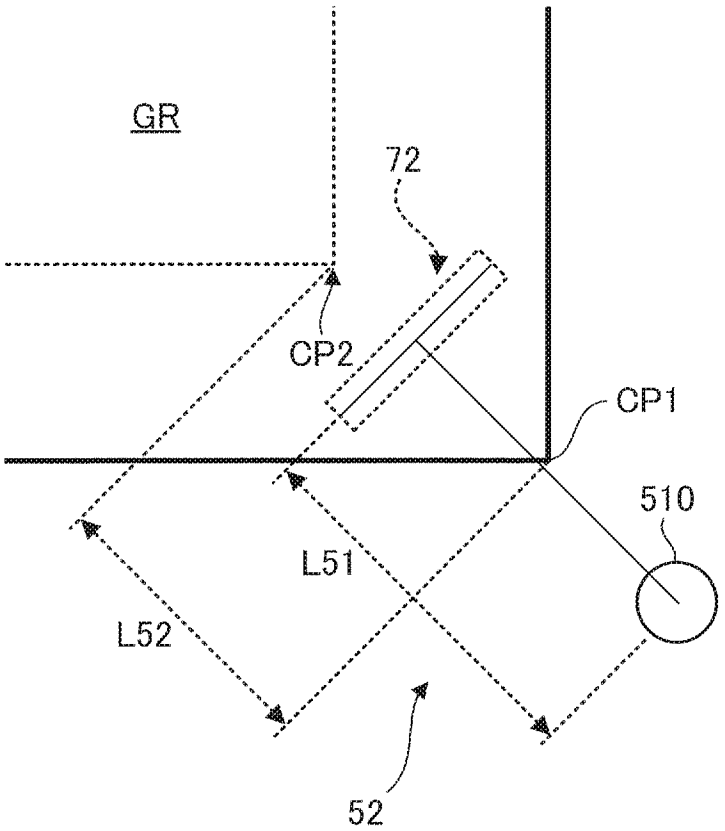
FIG. 20B shows the second binding processing device and the like, as seen from above.
Figure 20A:
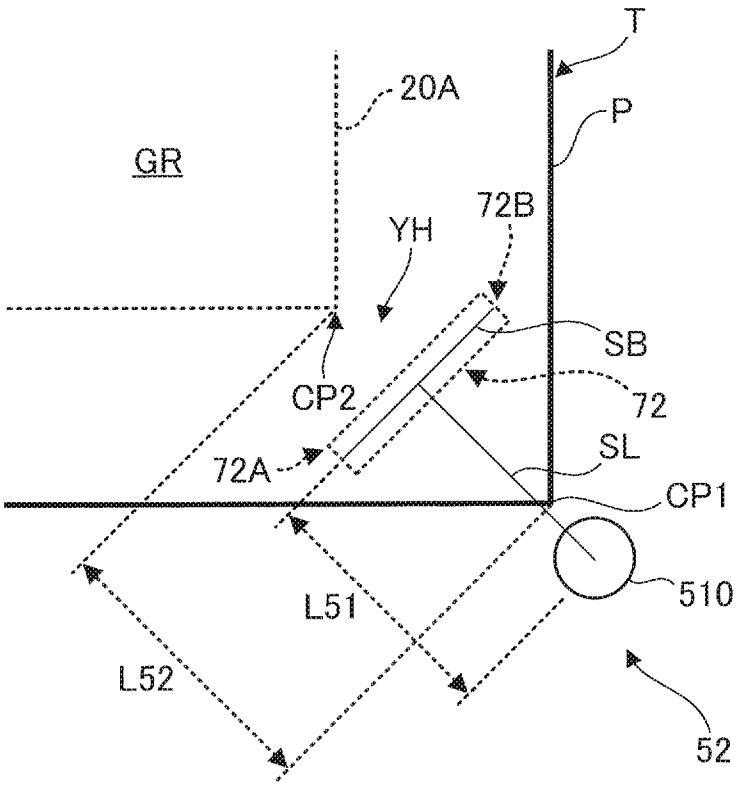
FIG. 20A shows the second binding processing device and the like, as seen from above.

More specifically, as shown in FIG. 20A (which shows the second binding processing device 52 and the like, as seen from above), in the exemplary embodiment, assuming a perpendicular bisector SL with respect to a line segment SB connecting one end 72A and the other end 72B of the second binding teeth 72 along the length direction of the second binding teeth 72, the screw member 510 as an example of the connection member is positioned on the perpendicular bisector SL.

In the exemplary embodiment, a spaced distance L51 between the second binding teeth 72 and the screw member 510 on the perpendicular bisector SL is set equal to or smaller than a dimension of a margin YH of a corner portion CP1 of the sheet P constituting the sheet bundle T.

The margin YH of the corner portion CP1 of the sheet P constituting the sheet bundle T indicates a portion positioned between a corner portion CP2 of a rectangular image forming region GR (an inner region of a broken line 20A), in which an image is formed, of the sheet P and the corner portion CP1 of the sheet P.

Also, the dimension of the margin YH of the corner portion CP1 of the sheet P constituting the sheet bundle T indicates a spaced distance L52 between the corner portion CP2 of the rectangular image forming region GR and the corner portion CP1 of the sheet P.

In the exemplary embodiment, the spaced distance L51 between the second binding teeth 72 and the screw member 510 on the perpendicular bisector SL is set equal to or smaller than the spaced distance L52 between the corner portion CP2 of the image forming region GR and the corner portion CP1 of the sheet P.

Here, as shown in FIG. 20B, a case is assumed in which the spaced distance L51 between the second binding teeth 72 and the screw member 510 is larger than the spaced distance L52 between the corner portion CP2 of the image forming region GR and the corner portion CP1 of the sheet P.

In this case, as shown in FIG. 20B, the screw member 510 is separated from the corner portion CP1 of the sheet P, and accordingly, the second binding processing device 52 is entirely separated from the sheet P.

In this case, the size of the first post-processing device 40 (refer to FIG. 1) is increased by an amount that the second binding processing device 52 is separated from the sheet P.

In contrast, when the spaced distance L51 between the second binding teeth 72 and the screw member 510 is equal to or smaller than the spaced distance L52 between the corner portion CP2 of the image forming region GR and the corner portion CP1 of the sheet P, the second binding processing device 52 is arranged closer to the sheet P. In this case, the enlargement of the first post-processing device 40 is suppressed.

Figure 21:
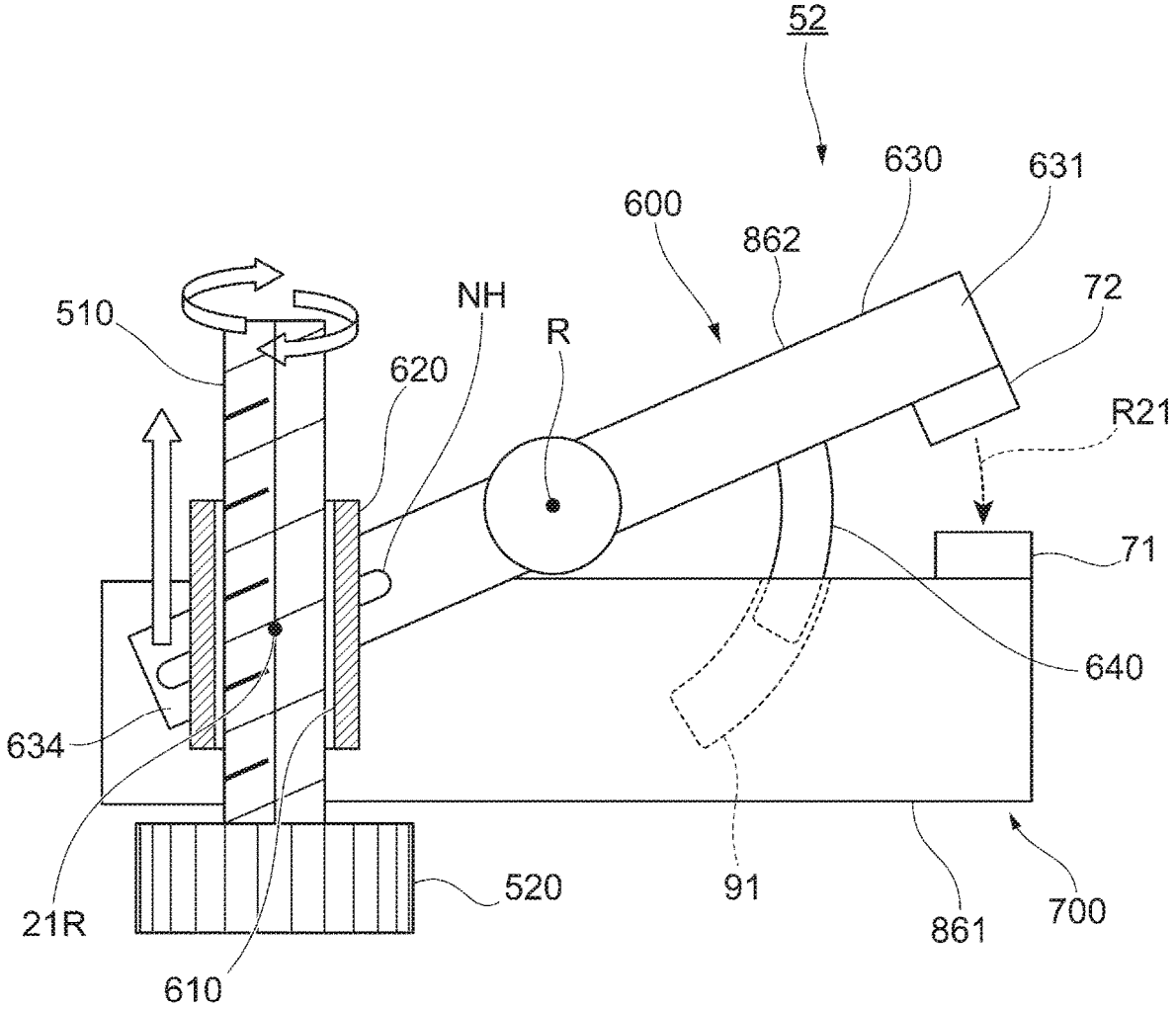
FIG. 21 shows another configuration example of the second binding processing device.

FIG. 21 shows another configuration example of the second binding processing device 52.

In the above, the second binding teeth 72 are moved along the linear moving path. However, the second binding teeth 72 may also be moved along a moving path R21 having a curvature.

In the configuration example shown in FIG. 21, the upper support member 630 is configured to rotate about a center R of rotation. Also, in this configuration example, the screw member 510 is connected to the other end portion 634 of the upper support member 630, and the second binding teeth 72 are attached to one end portion 631 of the upper support member 630.

More specifically, in this configuration example, the other end portion 634 of the upper support member 630 is provided with the load receiving member 620, and the second binding teeth 72 are attached to one end portion 631 of the upper support member 630.

The load receiving member 620 is provided with the female thread part 610, like the above.

Also, the load receiving member 620 is configured to be rotatable with respect to the upper support member 630. Specifically, the load receiving member 620 is configured to be rotatable about a rotary axis 21R extending in a direction orthogonal to the drawing sheet of FIG. 21.

In addition, the upper support member 630 is provided with a long hole NH. The rotary axis 21R, which is a center of rotation of the load receiving member 620, is positioned in the long hole NH and may be moved along the long hole NH. In other words, the load receiving member 620 is adapted to be movable along the long hole NH.

In this configuration example, when the screw member 510 rotates in the circumferential direction, the other end portion 634 of the upper support member 630 moves in the extension direction of the screw member 510, and accordingly, the second binding teeth 72 are advanced and retreated with respect to the first binding teeth 71.

Thereby, also in this configuration example, it is possible to perform the binding by using the first binding teeth 71 and the second binding teeth 72.

Even when the straight screw member 510 is used, the second binding teeth 72 may move along the moving path R21 having a curvature, as shown in FIG. 21, without moving along the linear moving path.

Also in the configuration example shown in FIG. 21, a guide part configured to guide that interlocking part 600 configured to interlock with the second binding teeth 72 is provided. Also in this configuration example, a guided part that is provided to the interlocking part 600 and is guided by the guide part is provided.

Specifically, also in this configuration example, a hole portion 91 is provided as the guide part. Also, as the guided part, the rod-shaped member 640 extending along the moving direction (moving path) of the interlocking part 600 and in contact with an inner surface of the hole portion 91 is provided.

Note that, in this configuration example, the rod-shaped member 640 is provided on the second binding teeth 72-side, and the hole portion 91 is provided on the first binding teeth 71-side. However, like the above, the hole portion 91 may be provided on the second binding teeth 72-side, and the rod-shaped member 640 may be provided on the first binding teeth 71-side.

Also, in the configuration example shown in FIG. 21, like the above, the upper support member 630 is formed by the second metal block 862, and the lower support member 700 is formed by the first metal block 861.

The other configuration examples are further described.

In the above, the configuration where the screw member 510 is connected to the second binding teeth 72-side and the second binding teeth 72 move has been exemplified. However, a configuration where the screw member 510 is connected to the first binding teeth 71-side and the first binding teeth 71 move is also possible.

Also, the screw member 510 may be provided to each of the first binding teeth 71 and the second binding teeth 72, and both the first binding teeth 71 and the second binding teeth 72 may be moved to perform the binding processing.

Also, when moving both the first binding teeth 71 and the second binding teeth 72, one common screw member 510 may be connected to the first binding teeth 71 and the second binding teeth 72. In this case, the one screw member 510 is rotated to bring the first binding teeth 71 and the second binding teeth 72 close to each other and to separate the same.

When one screw member 510 is used, the one screw member 510 is provided with a first thread portion whose thread grooves face in a clockwise direction and a second thread portion whose thread grooves face in a counterclockwise direction.

In this case, for example, the first binding teeth 71 are moved using the first thread portion, and the second binding teeth 72 are moved using the second thread portion.

The respective configurations described in the above are not limited to the embodiment and modified embodiments thereof, and may be changed without departing from the gist. In other words, a variety of changes in shapes and details may be made without departing from the gist and scope of the claims.

For example, some of the respective configurations described in the above may be omitted and other functions may be added to the respective configurations described in the above.

In the above, the plural embodiments has been described. However, the configurations included in one embodiment and the configurations included in another embodiment may be exchanged or the configurations included in one embodiment may be added to another embodiment.

In the recording material processing apparatus, the guided member may be inserted in a hole provided in the second metal block and may be guided by an inner surface of a hole provided in the first metal block.

In the recording material processing apparatus, as movement of the second metal block relative to the guided member, the second metal block may be moved in a direction of intersecting with a moving direction of the second teeth.

In the recording material processing apparatus, a part of the guided member facing the second metal block may be provided with a plane, and a part of the second metal block which faces the plane may be provided with a plane conforming to the plane.

In the recording material processing apparatus, the second metal block may have one end portion and other end portion, the second teeth may be provided to the one end portion of the second metal block, and the plane provided to the guided member and the plane provided to the second metal block may be arranged along a direction of intersecting with a direction facing from the one end portion toward the other end portion of the second metal block.

In the recording material processing apparatus, the second metal block may be provided with a hole for a moving member through which a moving member used to move the second metal block toward the first metal block passes, and at least two guiding holes in which guiding members used to guide the second metal block moving toward the first metal block are inserted, and the hole for a moving member may be provided between the two guiding holes.

In the recording material processing apparatus, the first metal block may be provided with a hole for a moving member through which a moving member used to move the second metal block toward the first metal block passes, and at least two guiding holes in which guiding members used to guide the second metal block moving toward the first metal block are inserted, and the hole for a moving member may be provided between the two guiding holes.

In the recording material processing apparatus, the first metal block may be a metal block formed by any one of casting, forging and sintering, and the second metal block may be a metal block formed by any one of casting, forging and sintering.

There may be provided an image forming system including: an image forming apparatus configured to form an image on a recording material; and the recording material processing apparatus configured to perform binding processing on a recording material bundle consisting of plural recording materials on which images have been formed by the image forming apparatus.

In the recording material processing apparatus, as the guided part provided to the interlocking part, at least two guided parts of a first guided part and a second guided part may be provided, and the second teeth may be positioned closer to the second guided part than the first guided part, and are positioned closer to the first guided part than the second guided part.

In the recording material processing apparatus, a load may be applied to a load receiving part of the interlocking part, so that the second teeth are moved toward the first teeth, as the guided part provided to the interlocking part, at least two guided parts of a first guided part and a second guided part may be provided, and the load receiving part may be positioned closer to the second guided part than the first guided part, and is positioned closer to the first guided part than the second guided part.

In the recording material processing apparatus, when the first guided part, the second guided part and the load receiving part are projected toward an upstream or downstream side with respect to a moving direction of the second teeth, the load receiving part may be positioned between the first guided part and the second guided part.

In the recording material processing apparatus, as the guided part provided to the interlocking part, at least two guided parts of a first guided part and a second guided part may be provided, and when the first guided part, the second guided part and the second teeth are projected toward an upstream or downstream side with respect to a moving direction of the second teeth, the second teeth may be positioned at a place deviating from a region between the first guided part and the second guided part.

In the recording material processing apparatus, when the first guided part, the second guided part and the second teeth may be projected toward the upstream or downstream side with respect to the moving direction of the second teeth, the second teeth may be positioned closer to the second guided part than the first guided part and may be positioned closer to the first guided part than the second guided part.

In the recording material processing apparatus, a load may be applied to a load receiving part of the interlocking part, so that the second teeth are moved toward the first teeth, and when the first guided part, the second guided part, the second teeth and the load receiving part are projected toward the upstream or downstream side with respect to the moving direction of the second teeth, the load receiving part may be positioned closer to a side on which the first guided part and the second guided are provided than the second teeth.

In the recording material processing apparatus, when the first guided part, the second guided part, the second teeth and the load receiving part are projected toward the upstream or downstream side with respect to the moving direction of the second teeth, the load receiving part may be positioned between the first guided part and the second guided part.

In the recording material processing apparatus, as the guided part provided to the interlocking part, at least two guided parts of a first guided part and a second guided part may be provided, and when the first guided part, the second guided part and the second teeth are projected toward an upstream or downstream side with respect to a moving direction of the second teeth, the second teeth may be positioned between the first guided part and the second guided part.

The recording material processing apparatus may further includes a connection member connected to the interlocking part and configured to apply a load for moving the second teeth to the interlocking part, in which the connection member may be positioned on a perpendicular bisector with respect to a line segment connecting one end and other end of the second teeth along a length direction of the second teeth, and a spaced distance between the second teeth and the connection member on the perpendicular bisector may be equal to or smaller than a dimension of a margin of a corner portion of a recording material constituting the recording material bundle.

There may be provided an image forming system including: an image forming apparatus configured to form an image on a recording material; and a recording material processing apparatus configured to perform binding processing on the recording material bundle consisting of plural recording materials on which images have been formed by the image forming apparatus.

In the recording material processing apparatus, the interlocking part may be provided with a first guided part that is guided by a guide part, and a second guided part that is guided by a guide part, and a part, which is in contact with the screw member, of the interlocking part may be positioned closer to the second guided part than the first guided part, and is positioned closer to the first guided part than the second guided part.

In the recording material processing apparatus, a restraint member configured to restrain movement of the interlocking part moving toward one end of the screw member may be attached to the one end.

In the recording material processing apparatus, when the screw member rotates in a circumferential direction, the interlocking part and the second teeth may be moved along an axis direction of the screw member.

In the recording material processing apparatus, hardness of a member, to which the second teeth are attached, of the interlocking part may be higher than hardness of a member to which the first teeth are attached.

In the recording material processing apparatus, the first teeth may be arranged in a stationary state without moving, and a volume of a member to which the first teeth are attached may be larger than a volume of a member, to which the second teeth are attached, of the interlocking part.

In the recording material processing apparatus, the first teeth may be arranged in a stationary state without moving, and when comparing a thickness in an axis direction of the screw member, a thickness of a member to which the first teeth are attached may be greater than a thickness of a member, to which the second teeth are attached, of the interlocking part.

The recording material processing apparatus may further includes a support member having one surface and other surface, configured to support the first teeth attached to the one surface-side and having a through-hole facing from the other surface toward the one surface, in which the screw member passes through the through-hole of the support member, the interlocking part is provided on the one surface-side of the support member, and when the screw member rotates in a circumferential direction, the interlocking part comes close to one surface of the support member and the second teeth attached to the interlocking part come close to the first teeth attached to the one surface-side.

The recording material processing apparatus may further includes a rotary body connected to the screw member and configured to receive a drive force that is transmitted to the screw member, in which the rotary body is provided on an opposite side to a side on which the interlocking part is provided, with the support member being interposed therebetween.

In the recording material processing apparatus, a bearing may be provided between the support member and the rotary body.

In the recording material processing apparatus, the interlocking part may be constituted by a combination of plural members, a member, to which the second teeth are attached, of the interlocking part may be constituted by a metallic block, and a member configured to support the first teeth may be constituted by a metallic block.

In the recording material processing apparatus, the metallic block to which the first teeth may be attached and the metallic block to which the second teeth may be attached are metallic sintered bodies.

There may be provided an image forming system including: an image forming apparatus configured to form an image on a recording material; and a recording material processing apparatus configured to perform binding processing on the recording material bundle consisting of plural recording materials on which images have been formed by the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

first teeth that are used for binding processing of a recording material bundle;

second teeth configured to be moved toward the first teeth and to press the recording material bundle positioned between the first teeth and the second teeth;

an interlocking part that is directly or indirectly connected to the second teeth so that the interlocking part is moved together with the second teeth when the second teeth is moved toward the first teeth, and that comprises a guided part; and a guide part along which the guided part is moved when the second teeth is moved toward the first teeth, wherein one of the guide part and the guided part comprises a hole, and the other comprises a rod-shaped part in contact with an inner surface of the hole, and wherein a longitudinal direction of the rod-shaped part is along a moving direction of the interlocking part, and wherein a contact area between the guide part and the guided part increases as the second teeth move toward the first teeth.

2. The recording material processing apparatus according to claim 1, wherein the hole extends along the moving direction of the interlocking part.

3. The recording material processing apparatus according to claim 1, comprising a plurality of the guide parts and a plurality of the guided parts.

4. The recording material processing apparatus according to claim 1, wherein the guided part provided to the interlocking part is the rod-shaped part, and the guide part is the hole configured to guide an outer surface of the rod-shaped part.

5. A recording material processing apparatus comprising:

first teeth that are used for binding processing of a recording material bundle;

second teeth configured to be moved toward the first teeth and to press the recording material bundle positioned between the first teeth and the second teeth;

an interlocking part that is directly or indirectly connected to the second teeth so that the interlocking part is moved together with the second teeth when the second teeth is moved toward the first teeth; and a screw member that is connected to the interlocking part, rotates in a circumferential direction, and moves the second teeth toward the first teeth, wherein the screw member is a multiple thread screw.

6. The recording material processing apparatus according to claim 5, further comprising a rotary body arranged coaxially with the screw member, having an outer diameter larger than an outer diameter of the screw member, and configured to receive a drive force that is transmitted to the screw member.

7. The recording material processing apparatus according to claim 5, wherein the interlocking part comprises a load receiving part provided movably to be in contact with the screw member to receive a load from the screw member, and a guided part that is guided by a guide part, and wherein the load receiving part is configured to move relative to the guided part.

8. The recording material processing apparatus according to claim 7, wherein the load receiving part is provided movably in a direction of intersecting with an axis direction of the screw member, as movement relative to the guided part.

9. A recording material processing apparatus comprising:

first teeth that are used for binding processing of a recording material bundle;

second teeth configured to be moved toward the first teeth and to press the recording material bundle positioned between the first teeth and the second teeth;

an interlocking part that is directly or indirectly connected to the second teeth so that the interlocking part is moved together with the second teeth when the second teeth is moved toward the first teeth; and a screw member that is connected to the interlocking part, rotates in a circumferential direction, and moves the second teeth toward the first teeth, wherein a rod-shaped member used for guide of the interlocking part configured to interlock with the second teeth is provided, and wherein an outer diameter of the screw member is smaller than an outer diameter of the rod-shaped member.

* * * * *